US007392979B2

(12) United States Patent
Sasaki et al.

(10) Patent No.: US 7,392,979 B2
(45) Date of Patent: Jul. 1, 2008

(54) PAPER SUPPLY DEVICE WITH MULTIPLE CAM SURFACES AND FOLLOWERS

(75) Inventors: Toshiyuki Sasaki, Yamagata-mura (JP); Takeshi Komaki, Matsumoto (JP); Shunpei Ogaya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 398 days.

(21) Appl. No.: 10/879,915

(22) Filed: Jun. 28, 2004

(65) Prior Publication Data

US 2005/0035531 A1 Feb. 17, 2005

(30) Foreign Application Priority Data

Jun. 27, 2003 (JP) ..... 2003-185622
Oct. 30, 2003 (JP) ..... 2003-370626

(51) Int. Cl.
*B65H 3/06* (2006.01)

(52) U.S. Cl. ..... 271/120; 271/126; 271/121; 271/119; 271/109

(58) Field of Classification Search ..... 271/126, 271/121, 137, 138, 117, 119, 120, 109
See application file for complete search history.

(56) References Cited

U.S. PATENT DOCUMENTS 5,058,877 A * 10/1991 Fujiwara et al. ..... 271/124
5,655,762 A * 8/1997 Yergenson ..... 271/121
5,697,716 A * 12/1997 Akahane ..... 400/624
5,984,297 A * 11/1999 Tanaka ..... 271/118
6,045,220 A * 4/2000 Kiyohara et al. ..... 347/104
6,059,281 A * 5/2000 Nakamura et al. ..... 271/119
6,367,795 B1 * 4/2002 Matsuda et al. ..... 271/126
7,114,716 B2 * 10/2006 Otsuka et al. ..... 271/121

FOREIGN PATENT DOCUMENTS

JP 4-016749 U 2/1992
JP 4-242757 8/1992
JP 07-257765 10/1995
JP 07257765 A * 10/1995

(Continued)

*Primary Examiner*—Patrick Mackey
*Assistant Examiner*—Gerald W McClain
(74) *Attorney, Agent, or Firm*—Baker + Hostetler, LLP

(57) ABSTRACT

A paper supply device for reliably delivering sheets of paper one at a time from a stock of multiple sheets even when the leading ends of the sheets are not neatly aligned together. This paper supply device M1 has a paper insertion part 11 for holding a plurality of sheets of paper S; a rotationally driven supply roller 20 having a fan-shaped profile including a circular arc part 23 and a bowed part 24; a pressure member 30 for resiliently urging the paper S to the supply roller 20 surface; a pressure member control mechanism 37 for displacing the pressure member 30 to a position separated from the supply roller 20 when the bowed part 24 is opposite the pressure member 30; a separation pad 40 being resiliently urged toward the trailing end of the stacked paper and having a rotating free end that pivots freely to change the angle of contact of the separation pad with the leading edge of the paper S and a pad control mechanism 47 for displacing the separation pad 40 to a position for aligning the ends of the paper S when the bowed part 24 opposes the pressure member 30.

9 Claims, 12 Drawing Sheets

FOREIGN PATENT DOCUMENTS

| | | | | |
|---|---|---|---|---|
| JP | 08-277044 | | | 10/1996 |
| JP | 09-216739 | | | 8/1997 |
| JP | 10-236673 | | | 9/1998 |
| JP | 10236673 | A | * | 9/1998 |
| JP | 2003026347 | A | * | 1/2003 |

* cited by examiner

PAPER SUPPLY DEVICE WITH MULTIPLE CAM SURFACES AND FOLLOWERS

BACKGROUND OF THE INVENTION

1. Field of the Invention

The present invention relates to a paper supply device for supplying paper one sheet at a time from a stack of multiple sheets to the processing unit of an apparatus such as a data reader or printer.

2. Description of Related Art

Roller-type paper supply devices are commonly used in printers, facsimile machines, copiers, and other office machines.

These roller-type paper supply devices typically have a cylindrical supply roller at the end in the paper feed direction, and a pressure means having a spring or other elastic means for pressing the paper to the supply roller so that the supply roller nips the paper near the leading edge of the sheet and feeds the paper into the paper path. A consistent paper supply operation can thus be achieved regardless of the stiffness (rigidity) of the paper by nipping and feeding the paper from the leading end.

Some paper supply devices also have a separation pad disposed downstream from the supply roller to separate the sheets one at a time from the stack using friction when the leading ends of the sheets slip. In this arrangement, locating the separation pad and supply roller close together affords better separation of multiple sheets.

However, if the supply roller is located at the end in the feed direction and the ends of the sheets are not aligned flush with each other, the end of the topmost sheet may not reach the point where the paper contacts the roller. The supply roller may therefore not be able to nip the end of the sheet, and it may not be possible to convey the sheet into the paper supply path.

Some means of aligning the ends of the sheets is therefore typically provided in such paper supply devices. The methods used to align the sheets are generally one of the following types.

In machines such as laser printers and photocopiers, the paper is generally stocked horizontally in a flat stack in a paper cassette that reliably positions the sides and top and bottom of the stack. See, for example, Japanese Patent Laid-Open Publication (kokai) H8-277044.

In inkjet printers, however, the paper is typically placed standing up vertically with the leading ends of the pages at the bottom so that gravity is used to drop the leading edge of the sheets to a pad at the bottom. See, for example, Japanese Patent Laid-Open Publication (kokai) S62-153033.

This method of horizontally stacking the paper to precisely position the sides and top and bottom surfaces requires a paper cassette, however, which makes it difficult to make the paper supply device smaller.

Setting the paper in a vertical stack and using gravity to drop the leading edge of the paper to the bottom pad makes it possible to reduce the size of the paper supply device. However, because the paper cannot be supplied if it is not stacked vertically, this limits the orientation in which the printer and paper supply device can be used.

Conventional roller-type paper supply devices thus use the transportation force created by a spring urging the supply roller against the paper to take the single sheet closest to the supply roller from the stack of multiple sheets loaded in the paper supply device. The problem with this arrangement is that if the spring is too strong, two or more sheets are supplied together, but if the spring is too weak, paper supply may be unreliable or impossible. Determining the appropriate spring force (transportation force) is therefore difficult.

An object of the present invention is therefore to solve these problems and provide a paper supply device that is small, simply constructed, and can be used in various postures while still reliably supplying paper one sheet at a time from a stack of multiple sheets even when the edges of the sheets are somewhat misaligned.

SUMMARY OF THE INVENTION

To achieve this object, a paper supply device according to the present invention is composed of a paper insertion part for holding a plurality of sheets of paper; a supply roller that is rotationally driven and has a fan-shaped profile with a circular arc part and a bowed part; a pressure member disposed to a position opposite the supply roller surface with the paper insertion part therebetween for resiliently urging the paper to the supply roller surface; and a pressure member control mechanism for displacing the pressure member to a position separated from the supply roller when the bowed part of the supply roller is opposite the pressure member with the paper insertion part therebetween.

The surface of the circular arc part of the supply roller is a round surface concentric to the axis of supply roller rotation, and the surface of the bowed part is a curved or substantially flat surface pulled to the inside of the imaginary line of said round surface.

With a paper supply device thus comprised, the pressure member is displaced by the pressure member control mechanism to a position separated from the supply roller in the standby position where the bowed part of the supply roller is opposite the pressure member with the paper insertion part therebetween. When the supply roller then rotates and the circular arc part of the supply roller is in the paper-conveying position opposite the pressure member, the pressure member resiliently urges the paper to the surface of the supply roller.

When the supply roller is in the standby position with the bowed part opposite the pressure member and then rotates a specific amount, the pressure member is released from the constraint of the pressure member control mechanism holding the pressure member displaced to the position separated from the supply roller. As a result, the pressure member then resiliently urges the paper held in the paper insertion part to the surface of the supply roller.

The paper then first contacts the first end (the part where the surface of the rotated supply roller changes from the bowed part to the circular arc part) of the circular arc part of the supply roller surface. The place where the supply roller first contacts the paper (the position where the supply roller nips the paper) can therefore be set to a position closer to the trailing end of the paper than the position where a cylindrical supply roller would make contact. As a result, when multiple sheets are stacked with the ends unaligned, the supply roller of the present invention can still reliably nip and supply sheets held with the leading edge offset to the trailing end of the stack. The paper supply device can thus consistently supply sheets of paper even when the sheets are not neatly aligned with each other.

Furthermore, in the standby position with the bowed part opposite the pressure member, the pressure member is offset by the pressure member control mechanism to a position separated from the supply roller. Sufficient space for loading paper between the supply roller and pressure member is thus assured because the bowed part is inset from the curve of the circular arc part, and paper can be easily loaded into the paper insertion part.

This paper supply device preferably also has a separation pad that is disposed to the paper insertion part downstream from the pressure member and rendered displaceable to change the contact angle to the leading edge of the paper; and a pad control mechanism for displacing the separation pad to a posture where the separation pad can position the ends of the paper when the bowed part of the supply roller is opposite the pressure member with the paper insertion part therebetween.

With a paper supply device thus arranged, the separation pad is set to a standby position where it can position the ends of the paper when the bowed part of the supply roller is in the standby position opposite the pressure member with the paper insertion part therebetween. When the supply roller then turns and the circular arc part of the supply roller opposes the pressure member in the paper-conveying position, the separation pad is displaced to the transportation position contacting the paper ends at a specific angle.

When the bowed part is in the standby position opposite the pressure member and paper is loaded in the paper insertion part, the separation pad is positioned substantially perpendicular to the ends of the paper, and the ends of the paper can thus be positioned. Paper set into the paper insertion part will therefore not enter accidentally to the downstream paper transportation path.

As the supply roller is rotationally driven to sequentially feed multiple sheets one at a time, the separation pad is displaced to contact the paper ends at a specific angle, and then returns to the position perpendicular to the paper ends each time the bowed part moves to the position opposite the pressure member. As a result, after separating and conveying the single topmost sheet (the sheet facing the supply roller) from a stack of multiple sheets, the ends of the remaining sheets are pushed back by the separation pad, and the ends of the sheets are thus aligned with each other. Because the pressure member is offset to a position separated from the supply roller, the sheets of paper can move freely, and the ends can be easily aligned by the separation pad.

Yet further preferably, the pressure member control mechanism and pad control mechanism are each composed of a disc cam that has two cam surfaces and rotates in unison with the supply roller, and cam followers disposed to the pressure member and separation pad so as to slide against the cam surfaces.

This arrangement for driving the pressure member and separation pad by means of cam surfaces rendered on a disc cam that rotates in unison with the supply roller, and cam followers disposed to the pressure member and separation pad, simplifies the construction of the paper supply device.

Yet further preferably, this paper supply device also has a pad rotation regulating mechanism for locking and constraining rotation of the separation pad displaced to the posture for positioning the paper ends.

When the paper supply device thus comprised is in the standby position with the bowed part of the supply roller opposite the pressure member with the paper insertion part therebetween, the separation pad is set to the position where it can position the paper ends, and is locked and prevented from rotating from this position.

The separation pad can therefore position the ends of the paper. Paper set into the paper insertion part is also prevented from accidentally entering the downstream paper transportation path, and supplying two or more sheets as a result of the paper being inserted too far into the transportation path can be prevented.

When the supply roller rotates and is in the paper supply position with the circular arc part of the supply roller opposite the pressure member, the rotating free end is urged toward the trailing end of the paper so that the contact angle of the separation pad to the paper ends can be changed.

Therefore, when the supply roller is rotationally driven to sequentially feed multiple sheets, individual sheets can be smoothly separated and supplied from the stack while the contact angle of the separation pad is automatically adjusted by the balance between the stiffness of the paper and the urging force of the separation pad. The separated sheet is then transported held between the circular arc part of the supply roller and the separation pad.

Further preferably, the pad rotation regulating mechanism prevents the separation pad from pivoting to the posture where the paper ends can be positioned when the rotating free end of the separation pad is in contact with the sheet being conveyed.

The paper supply device thus comprised can prevent the separation pad from rotating to the position where it can position the ends of the paper when the rotating free end of the separation pad is touching the sheet being supplied (that is, while the trailing end of the sheet is still on the separation pad after the circular arc part of the supply roller has rotated away from the separation pad) after the circular arc part of the supply roller passes the separation pad.

The separation pad can thus be prevented from applying unnecessary force to the paper, and the paper can be supplied smoothly to the end.

Yet further preferably, the pad rotation regulating mechanism includes a cam member that has a cam surface and rotates in unison with the supply roller, and a cam follower disposed to the separation pad so as to contact the cam surface.

Yet further preferably, the cam surface includes a first cam surface that contacts the cam follower and locks the separation pad in the posture for positioning the paper ends when the bowed part of the supply roller is opposite the pressure member with the paper insertion part therebetween; and a second cam surface that contacts the cam follower when the rotating free end of the separation pad is in contact with the sheet being conveyed, thereby preventing the separation pad from pivoting to the posture where it can position the paper ends while producing a rotational delay in a cam member rendered so that its rotation can be delayed a specific amount in the rotational drive direction of the supply roller.

The construction of the pad rotation regulating mechanism can thus be simplified by driving the separation pad with the cam surface of a disc cam that rotates in unison with the supply roller and a cam follower disposed to the separation pad.

A paper supply device according to another implementation of the present invention that also achieves the above object includes a paper insertion part for holding a plurality of sheets of paper; a supply roller that is rotationally driven and has a fan-shaped profile with a circular arc part and a bowed part; a pressure member disposed opposite the supply roller surface and supported movably to the paper insertion part; a first elastic member for urging the pressure member to the circular arc part of the supply roller; a separation pad disposed to the paper insertion part on a downstream side from the pressure member so as to contact the paper ends, and supported movably to the paper insertion part; and a second elastic member for urging the separation pad to the circular arc part of the supply roller.

When the supply roller rotates to the position where the circular arc part is opposite the pressure member, the pressure member is urged by the first elastic member to the circular arc part of the supply roller, and the force of the supply roller thus works to convey the one topmost sheet due to the friction produced between the circular arc part of the supply roller and said topmost sheet in the stack of multiple sheets (the sheet on the supply roller side). Friction is also produced between the other sheets between the supply roller and pressure member, and the force of the supply roller also works to convey all of those sheets toward the separation pad as a result of the friction between the sheets.

At the same time, the ends of the sheets contact the separation pad at a specific angle, and the separation pad thus produces force preventing transportation of these other sheets. Because the force blocking paper transportation is greater than the friction produced between the sheets and weaker than the friction between the supply roller and the one topmost sheet, the one topmost sheet (on the supply roller side) of the multiple sheets is separated from the stack and transported, leaving the other sheets in the paper insertion part.

When the supply roller rotates further, the separation pad is urged to the circular arc part of the supply roller by the second elastic member, and the separated sheet is thus held and transported between the separation pad and circular arc part of the supply roller.

With the paper supply device thus comprised, transportation force determined by the urging force of the first elastic member acts on the paper when the paper is held between the circular arc part of the supply roller and the pressure member, and transportation force determined by the urging force of the second elastic member acts on the paper when the paper is held between the circular arc part of the supply roller and the separation pad.

Yet further preferably in this paper supply device, the force of the second elastic member urging the separation pad to the circular arc part of the supply roller is greater than the force of the first elastic member urging the pressure member to the circular arc part of the supply roller.

Because the urging force of the pressure member acts on all of the multiple sheets held in the paper insertion part, it is set so that multiple sheets are not conveyed together and the one topmost sheet of the stack can be separated and delivered from the other multiple sheets. On the other hand, because the sheet held between the separation pad and the supply roller is only the one sheet separated from the stack, a stronger force can be used to urge the separation pad to the supply roller, and the sheet can therefore be reliably held between the circular arc part of the supply roller and the separation pad and carried downstream.

[Effect of the Invention]

With a paper supply device according to the present invention described above, the pressure member resiliently urges the paper stocked in the paper insertion part to the surface of the supply roller when the supply roller rotates a specific amount from the standby position where the bowed part thereof opposes the pressure member with the paper insertion part therebetween, and the constraint of the pressure member control mechanism holding the pressure member offset to a position separated from the supply roller is removed.

The paper then first contacts the leading end of the circular arc part of the supply roller surface. More specifically, the position where the supply roller first contacts the paper can be set to a position closer to the trailing end of the paper than the position where a cylindrical supply roller would make contact.

As a result, even when the edges of the paper are not neatly arranged together and the leading edge of the topmost sheet is offset to the trailing end of the stack, the supply roller can reliably nip and advance the topmost sheet. Sheets of paper can therefore be consistently supplied individually from a stack even when the leading edges of the sheets are not all together.

Furthermore, in the standby position with the bowed part opposite the pressure member, the pressure member is moved by the pressure member control mechanism to a position separated from the supply roller, and because the bowed part is inside the imaginary surface of the circular arc part, sufficient space can be assured between the supply roller and the pressure member for loading paper, and paper can be easily inserted to the paper insertion part.

Furthermore, when the bowed part of the supply roller is in the standby position opposite the pressure member with the paper insertion part therebetween, the separation pad is displaced to the posture where it can position the paper ends and locked so that it cannot rotate. The separation pad can therefore position the ends of the paper, and paper loaded into the paper insertion part can be prevented from accidentally entering the downstream paper transportation path. Feeding two or more sheets due to the paper being set too far beyond the specified position can thus be prevented.

Furthermore, transportation force determined by the urging force produced by a first elastic member works on the paper held between the circular arc part of the supply roller and the pressure member so that the one topmost sheet is separated from a stack of multiple sheets in a paper supply device according to the present invention. The separated sheet is then held between the circular arc part of the supply roller and a separation pad, and a transportation force determined by the urging force produced by a second elastic member works to convey the paper further downstream. The paper supply device of this invention can thus reliably separate and supply sheets one at a time from a stack of multiple sheets of paper or other medium without supply errors such as multiple sheets being delivered from the stack together.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 3(*b*) is a plan view showing the relative positions of the essential parts of FIG. 3(*a*);

DESCRIPTION OF THE PREFERRED EMBODIMENTS

A paper supply device according to a preferred embodiment of the present invention is described in detail below with reference to the accompanying figures.

Figure 1:
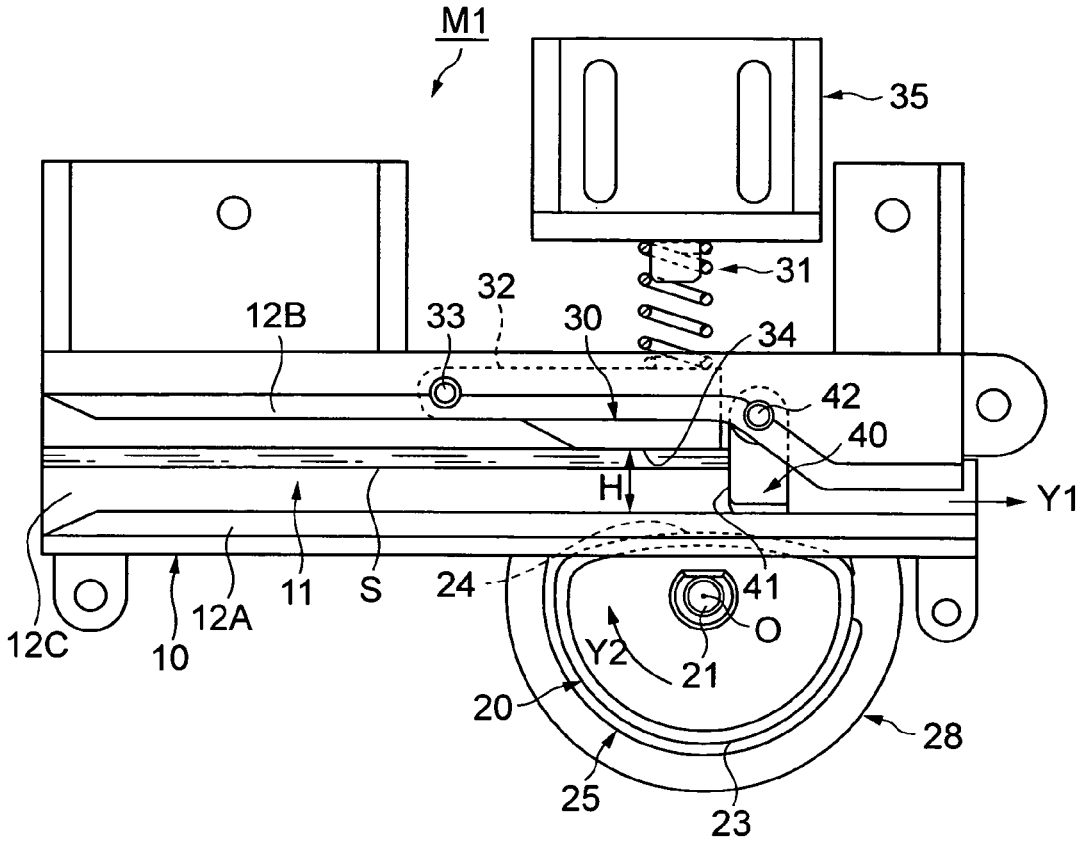
FIG. 1(*a*) is a plan view showing the overall arrangement of a first embodiment of the invention FIG. 1(*b*) is a plan view of the paper supply device of FIG. 1(*a*) showing the relative positions of the essential parts.
Figure 1:
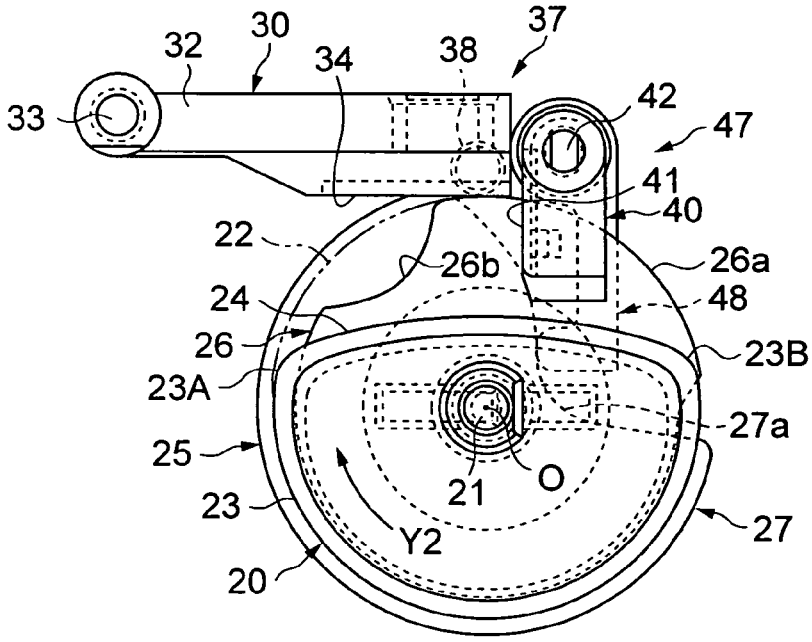
Figure 3:
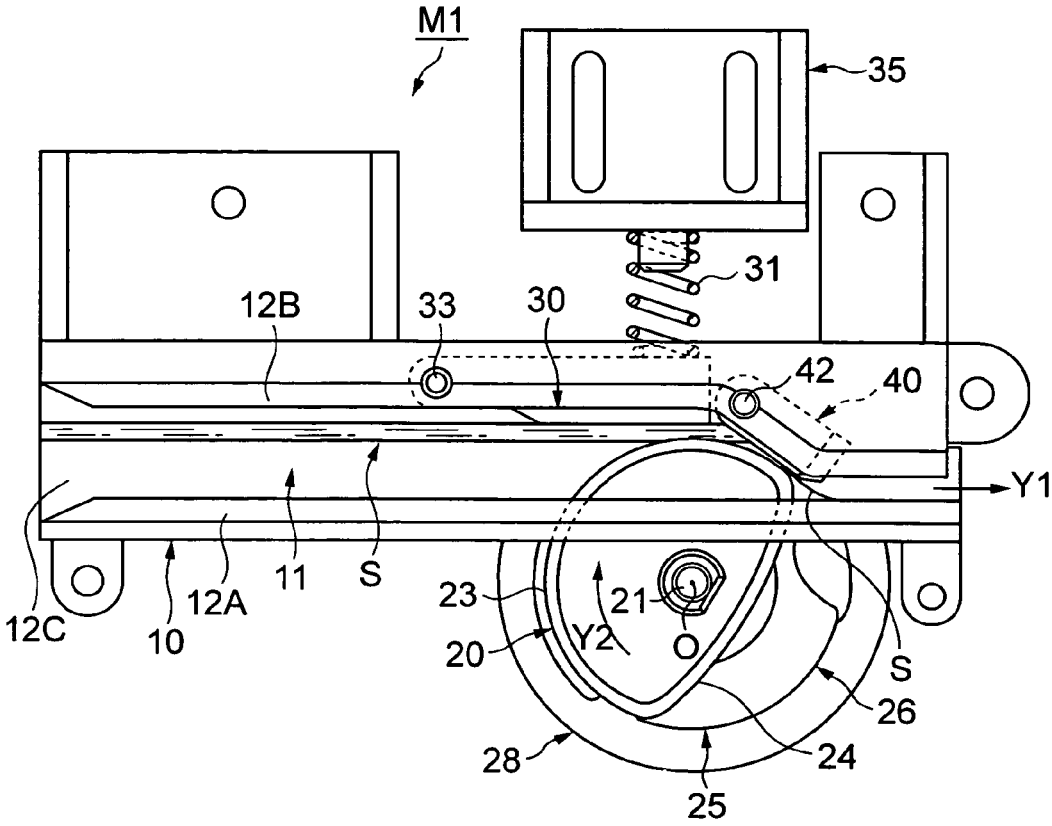
FIG. 3(*a*) is yet another plan view showing the overall arrangement of the paper supply device of FIG. 2(*a*)
Figure 3:
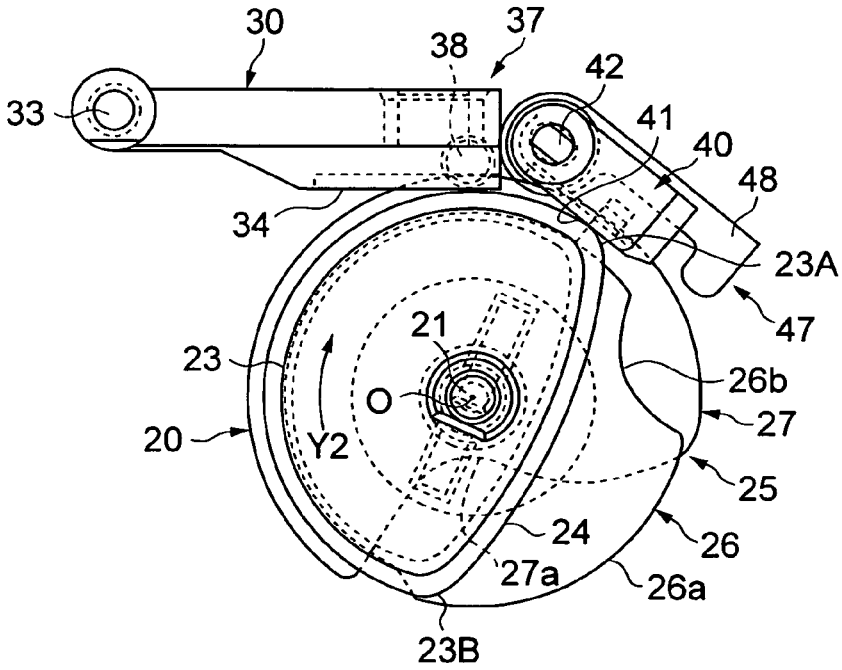
Figure 4:
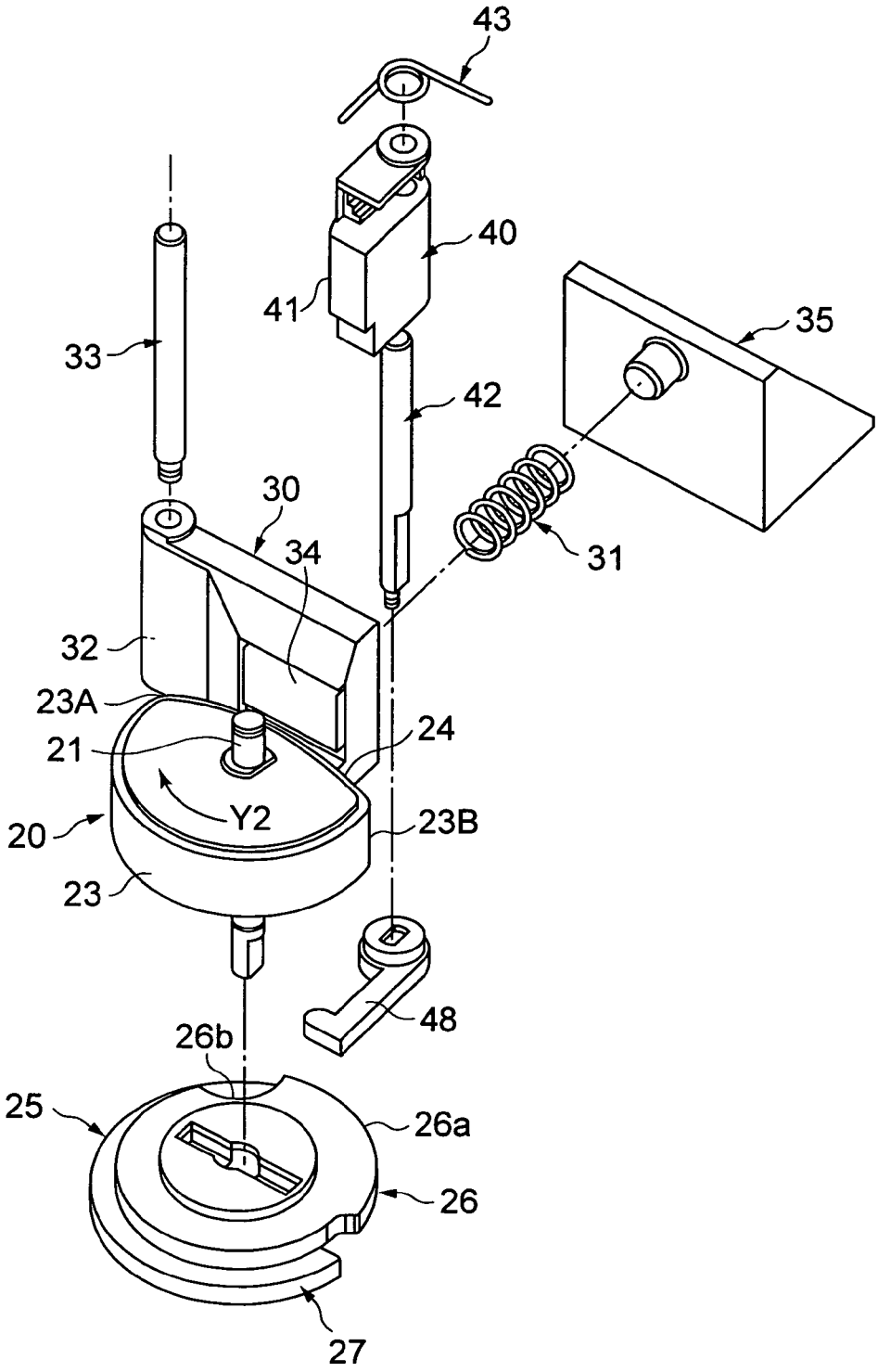
FIG. 4 is an exploded oblique view showing the essential parts of the paper supply device of FIG. 1(*a*)
Figure 5:
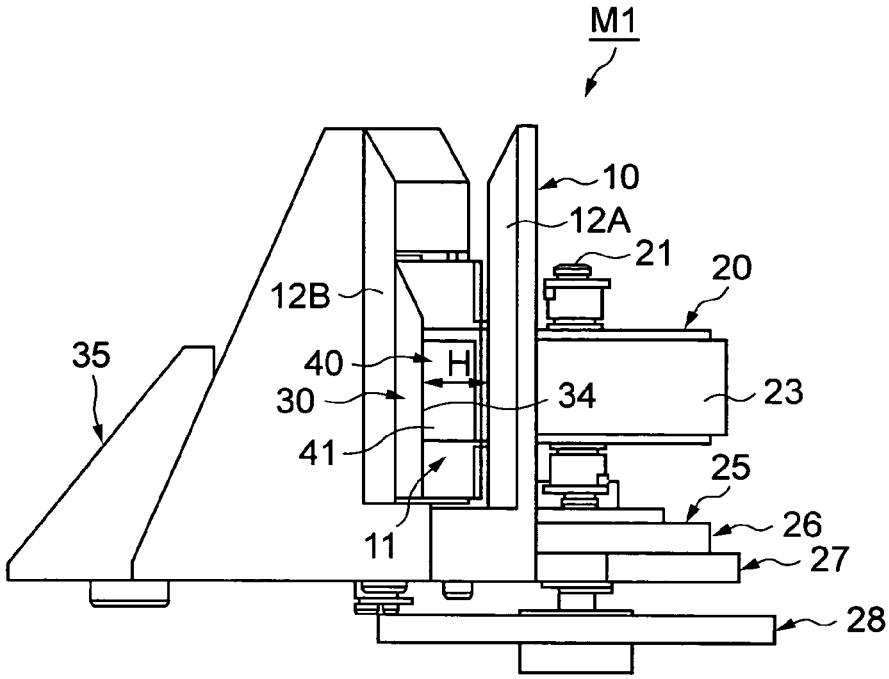
FIG. 5 is a front view of the overall arrangement of the paper supply device shown in FIG. 1(*a*)
Figure 6:
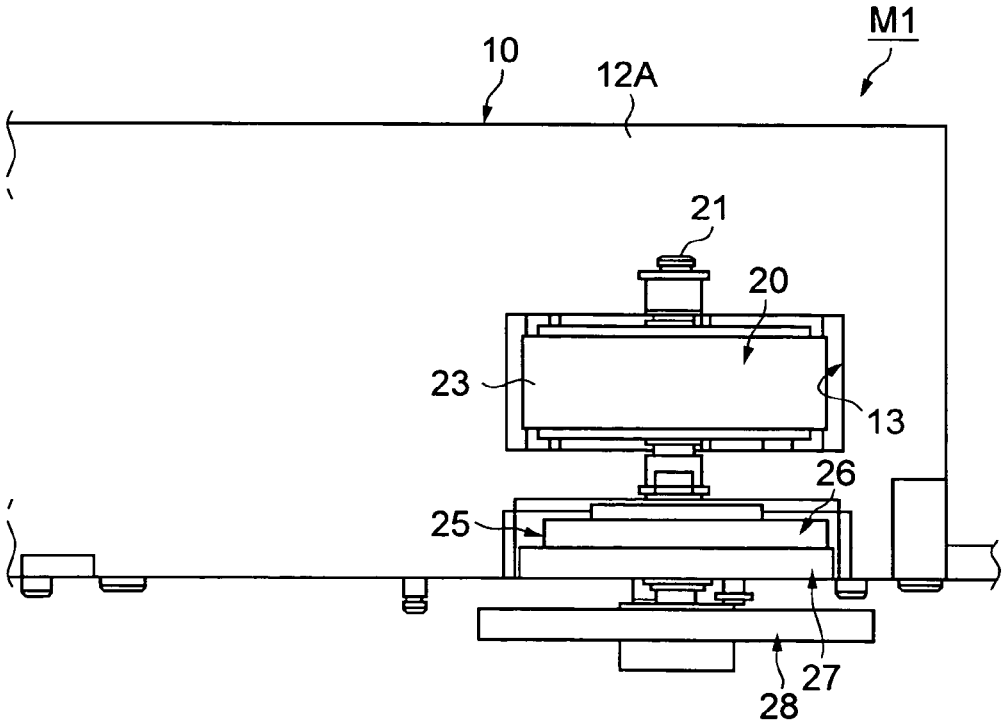
FIG. 6 is a side view of the overall arrangement of the paper supply device shown in FIG. 1(*a*)

FIG. 1(*a*), 2(*a*) and FIG. 3(*a*) are respective plan views showing the overall arrangement of the paper supply device of the first embodiment, and FIGS. 1(*b*), 2(*b*) and 3(*b*) show the relative positions of the essential parts of the paper supply device of FIG. 1(*a*), 1(*b*) and 1(*c*) respectively. FIG. 4 is an exploded oblique view showing the essential parts in FIG. 1, and FIG. 5 and FIG. 6 are front and side views, respectively, of the overall arrangement of the paper supply device shown in FIG. 1.

In the paper supply device M1 according to this first embodiment of the invention checks (paper) S are set standing on edge in paper holder 10 with the leading ends facing the horizontal direction (in the direction of arrow Y1, the right side in the figure), and are conveyed horizontally in this posture in the direction of arrow Y1.

The paper holder 10 is fixed to a frame not shown, and includes a pair of side walls 12A, 12B forming paper insertion part 11 where a batch of multiple checks S can be loaded, and a bottom 12C on which the bottom edges of the checks S rest.

As shown in FIG. 4, the main components whereby this paper supply device M1 supplies one check S at a time from the stack of checks S in the paper holder 10 include supply roller 20, pressure member 30, and friction separation pad 40.

The supply roller 20 is disposed on the side of one wall 12A of the paper holder 10, and the pressure member 30 is disposed on the side of the other wall 12B on the opposite side of the paper insertion part 11. The separation pad 40 is located downstream from the pressure member 30 in the check S feed direction (the direction of arrow Y1).

The supply roller 20 is fixed to roller shaft 21 supported freely rotatably on the frame not shown. The supply roller 20 is rotationally driven in the direction of arrow Y2 by a motor (drive means) not shown to supply a check S using the roller surface of the supply roller 20 to the downstream paper transportation path. The roller shaft 21 is rendered perpendicular (vertically in the figures) to the transportation direction in order to turn the supply roller 20 in the transportation direction.

The supply roller 20 is fan-shaped with a circular arc part 23 and a bowed part 24. The circumferential surface of the circular arc part 23 is the surface of an imaginary cylinder 22 concentric to the axis of rotation O of the supply roller 20, and the bowed part 24 is a gradually curved surface pulled to the inside from the surface of the imaginary cylinder 22.

The surface of this supply roller 20 is lined with rubber or other high friction material. The supply roller 20 is disposed so that as the circular arc part 23 turns, it protrudes into the space inside the paper insertion part 11 through an aperture 13 formed in the one wall 12A of the paper holder 10 as shown in FIG. 6.

The pressure member 30 (also called a hopper) is positioned opposite the surface of the supply roller 20 from the other side of the paper insertion part 11. The pressure member 30 is urged toward the supply roller 20 by a compression spring (first elastic member) 31, and thereby presses a check S in the paper insertion part 11 to the surface of the supply roller 20.

The pressure member 30 is disposed substantially parallel to the other wall 12B of the paper holder 10 in an aperture (not shown) formed in that wall 12B. The base portion 32 of the pressure member 30 on the upstream side in the transportation direction is supported by a shaft 33 fixed to the frame, enabling the free end of the pressure member 30 to pivot on the shaft 33. This shaft 33 is parallel to the axis of rotation O of the supply roller 20.

The part of the pressure member 30 that contacts the checks S protrudes to the supply roller 20 side from the rest of the pressure member 30, forming the pressure surface 34 to which a cork sheet or other high friction material is disposed. The top and base portion 32 sides of this pressure surface 34 are sloped so that they do not interfere with dropping checks S into the paper insertion part 11.

The base of the compression spring 31 urging the pressure member 30 to the supply roller 20 side is held on a spring retainer 35 located behind the pressure member 30.

The separation pad 40 separates one check S at a time from the multiple checks S stocked in the paper insertion part 11 as a result of the leading end of the check S conveyed between the supply roller 20 and pressure member 30 sliding over the pad surface 41.

This friction separation pad 40 is pivotally supported on support shaft 42 located near the free end of the pressure member 30, and the pivoting free end is resiliently urged in the direction of the trailing end of the check S by a torsion spring 43 (second elastic member).

As shown in FIG. 1, the separation pad 40 is displaced to a position substantially perpendicular to the paper insertion part 11 (the "standby position" below) when there is no interference from the circular arc part 23 of the supply roller 20 protruding into the paper insertion part 11. The checks S can thus be positioned with the leading edges of the checks S aligned with each other when the separation pad 40 is in this standby position. Rotational displacement of the separation pad 40 is limited by a cam follower 48 contacting the pad drive cam 27 as further described below.

Figure 2:
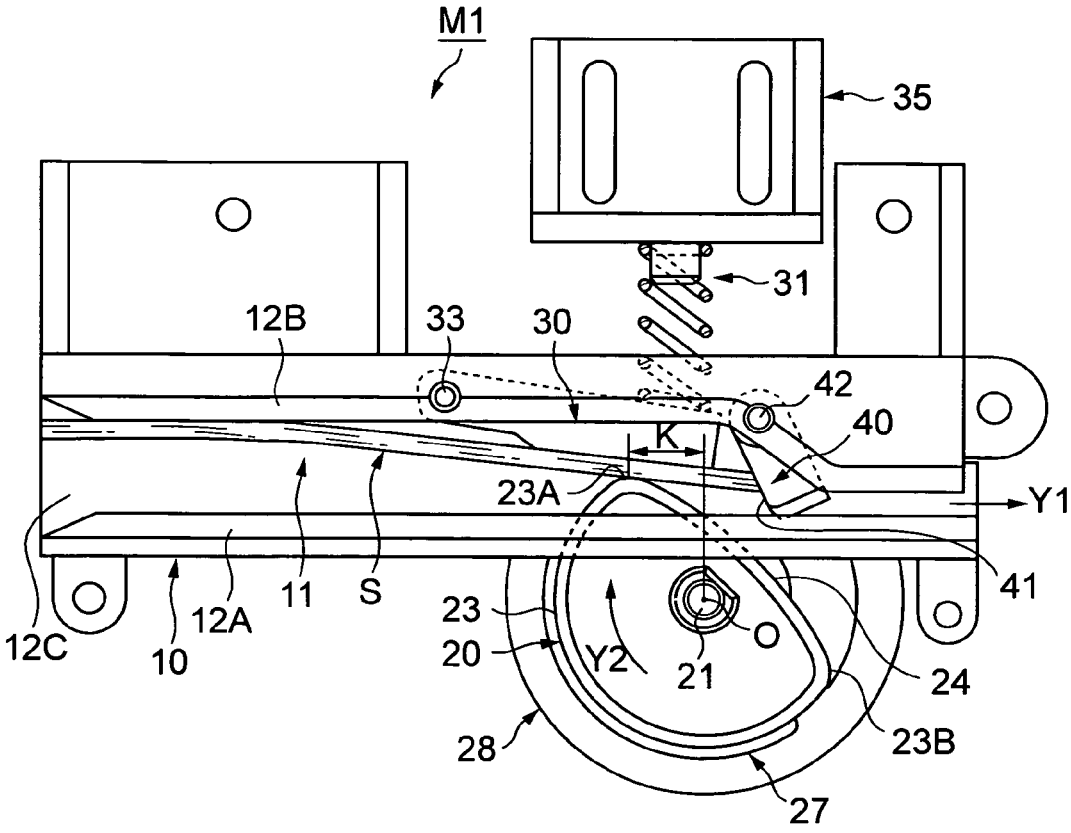
FIG. 2(*a*) is another plan view showing the overall arrangement of the paper supply device of FIG. 1(*a*), FIG. 2(*b*) is another plan view showing the relative positions of the essential parts of FIG. 2(*a*)
Figure 2:
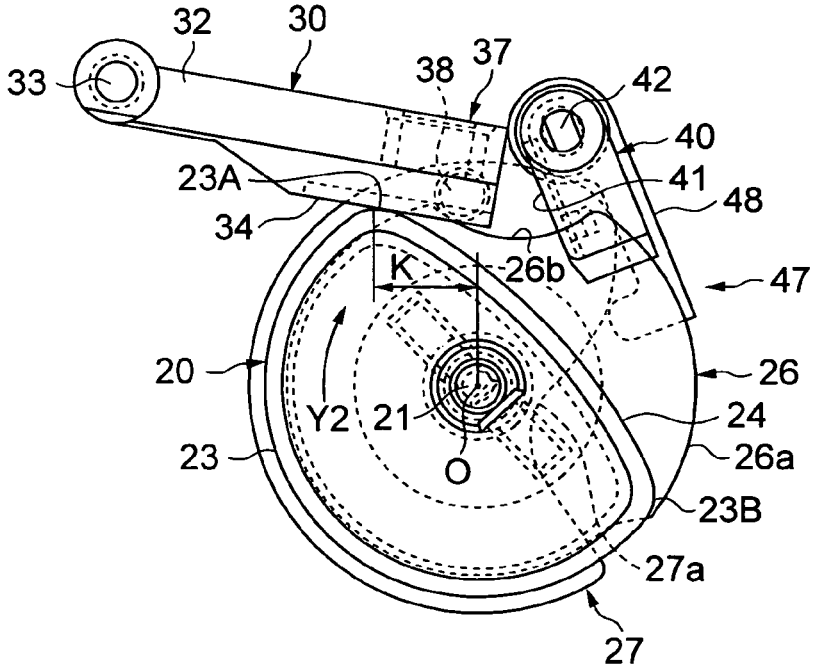

The separation pad does not need to be resiliently urged in a rotational direction. It could, for example, be arranged so that it is resiliently urged to slide back and forth to the surface of the supply roller 20. In this arrangement the contact surface of the separation pad 40 to the check S is inclined as shown in FIG. 2, and the separation pad slides substantially orthogonally to the contact surface. When the separation pad is not opposite the circular arc part 23 of the supply roller 20, it contacts the ends of the checks S at an angle and thus positions the check S ends.

This paper supply device M1 also has a pressure member control mechanism 37 and pad control mechanism 47 for displacing the pressure member 30 and separation pad 40 according to the rotational position of the supply roller 20.

The pressure member control mechanism 37 includes the pressure member drive cam (cam surface) 26 of disc cam 25, and a cam follower 38. The pressure member drive cam 26 is fixed to the roller shaft (rotational axis) 21 of the supply roller 20 and thus rotates in unison with the supply roller 20. The cam follower 38 is disposed to the pressure member 30 to slide in contact with the pressure member drive cam 26.

The pad control mechanism 47 includes the pad drive cam 27 (cam surface) of the disc cam 25, and a cam follower 48 fixed to the separation pad 40 side to slide against the pad drive cam 27. The pad drive cam 27 is fixed to the roller shaft 21 of the supply roller 20 and thus rotates in unison with the supply roller 20.

The separation pad 40 and cam follower 48 are press-fit and fixed to support shaft 42, which is supported freely rotatably on the frame, and rotate in unison.

As shown in FIG. 5 and FIG. 6, a transfer gear 28 for transferring rotation of a motor not shown to the supply roller 20 and disc cam 25 by way of intervening roller shaft 21 is fixed to the bottom end of the roller shaft 21 of supply roller 20.

The pressure member 30 and separation pad 40 are thus driven in conjunction with rotation of the supply roller 20 as a result of cam followers 38 and 48 following the pressure member drive cams 26 and 27 of disc cam 25.

The cam profile of the pressure member drive cam 26 of the pressure member control mechanism 37 regulates the position of the pressure member 30 to the supply roller 20 in resistance to the urging force of the compression spring 31, and displaces the pressure member 30 to the standby position away from the supply roller 20 when the bowed part 24 of the supply roller 20 is in the standby position substantially parallel to the pressure member 30 on the opposite side of the paper insertion part 11.

As shown in FIG. 2 and FIG. 3, when the leading edge 23A of the circular arc part 23 of supply roller 20 (that is, the part where the surface of the rotating supply roller 20 changes from the bowed part 24 to the circular arc part 23) starts to approach the pressure member 30 and while the circular arc part 23 is opposite the pressure member 30, the pressure member 30 is released from the constraint holding the pressure member 30 in the standby position. As a result, the pressure member 30 is displaced to the position (pressure position) where the force of compression spring 31 pushes the pressure member 30 toward the circular arc part 23 of supply roller 20.

Furthermore, the cam profile of the pad drive cam 27 of pad control mechanism 47 is set so that from when the leading edge 23A of the circular arc part 23 of supply roller 20 starts to approach the pressure member 30 and then contacts the checks S as shown in FIG. 2, the separation pad 40 is displaced from the standby position to the position where it contacts the leading ends of the checks S at a specific angle (such as a 45 degree angle) in resistance to the force of the torsion spring 43.

Furthermore, the paper supply device M1 of this embodiment is arranged so that when the check S is transported by rotation of the supply roller 20, the pressure member 30 and separation pad 40 are resiliently urged to the circular arc part 23 of the supply roller 20. In addition, the urging force of the separation pad 40 is greater than the urging force of the pressure member 30 in order to prevent feeding multiple checks S and to reliably separate and feed only the one top check S from the stack of multiple checks S. The urging force of the pressure member 30 is weak, that is, only strong enough to press the checks S to the circular arc part 23 of the supply roller 20 without holding the checks S strongly. The force of the separation pad 40, however, is great enough to assure that a check S is held reliably between the separation pad 40 and the circular arc part 23 of the supply roller 20. In this embodiment of the invention, the force of pressure member 30 is 20 gf, and the force of the separation pad 40 is 200 gf.

Operation of a paper supply device M1 thus comprised according to a first embodiment of the present invention is described next.

When checks S are supplied from a stack of multiple checks S by a paper supply device M1 according to this embodiment of the invention, the stack of checks S is set in the paper holder 10 standing on edge with the ends of the checks S in the horizontal direction (the leading edge to the right as seen in FIG. 1).

The greatest-radius cam portion 26*a* of the pressure member drive cam 26 contacts cam follower 38 of pressure member 30 at this time, and the pressure member 30 is thus held at the standby position separated farthest from the supply roller 20 in resistance to the force of compression spring 31. Furthermore, because the bowed part 24 of supply roller 20 is positioned substantially parallel to the pressure member 30, the paper insertion part 11 is open to the widest effective width H, and multiple checks S can be easily inserted.

The separation pad 40 is also held in a position (blocking the paper path downstream of the paper insertion part 11: the standby position) substantially perpendicular to the paper insertion part 11 where the separation pad 40 can position the ends of the checks S as a result of the cam follower 48 dropping into cutout 27*a* in the pad drive cam 27.

The separation pad 40 can thus align the ends of the checks S when checks S are loaded to the paper insertion part 11 when the bowed part 24 of the supply roller 20 is opposite the pressure member 30 in the standby position. That is, checks S loaded into the paper insertion part 11 are prevented from unintentionally entering the downstream paper transportation path.

When rotation of the motor not shown is then transferred to the supply roller 20 by way of intervening transfer gear 28, supply roller 20 turns in the direction of arrow Y2, and the leading edge 23A of the circular arc part 23 of the supply roller 20 gradually approaches the pressure member 30 side as shown in FIG. 2.

When the cam follower 38 of pressure member 30 then drops into the cutout 26*b* of the pressure member drive cam 26, the pressure member 30 is released from the standby position, thus moves from the standby position to the pressure position, and pushes the checks S to the surface of the supply roller 20.

Because the supply roller 20 is now positioned with the leading edge 23A of the circular arc part 23 juxtaposed to the pressure member 30 on the upstream side of the supply roller 20 axis of rotation O in the feed direction (that is, the left side in FIG. 2), the checks S first touch the leading edge 23A of the circular arc part 23 of the supply roller 20 at a position on the upstream side of the axis of rotation O in the feed direction. This position is distance K on the upstream side from the axis of rotation O of the supply roller 20. This distance K is approximately ½ the radius of supply roller 20. Therefore, even if the leading edge of the checks S is distance K upstream from the axis of rotation O, the circular arc part 23 of supply roller 20 can reliably nip the leading end of the check S.

When supply roller 20 rotates further from this position, rotation of the circular arc part 23 pushes the pressure member 30 back toward the standby position, and the topmost check S is conveyed off the stack in the feed direction (in the direction of arrow Y1) between the surface of circular arc part 23 and the pressure member 30 as shown in FIG. 3. Because the pressure member 30 is urged to the circular arc part 23 of supply roller 20 by the compression spring 31 at this time, the friction created between the circular arc part 23 of supply roller 20 and the one check S on the surface of the stack of checks S between the pressure member 30 and said circular arc part 23 (i.e., the check S on the feed roller side) works to convey only the top check S. Friction also occurs between the other sheets held therebetween, and friction between each of the sheets works to convey all of the checks S to the separation pad 40.

The separation pad 40 has already been displaced from the standby position to the paper feed position in resistance to the force of the torsion spring 43 by the action of pad drive cam 27 as shown in FIG. 2, however, and the separation pad 40 is therefore inclined at a specific angle to the ends of the checks S. In other words, transportation of the checks S is obstructed by the separation pad 40 contacting the ends of the checks S at this angle.

The urging force of compression spring 31 and torsion spring 43, and the angle between the separation pad 40 and the ends of the checks S, are set so that the force inhibiting check S transportation is greater than the friction between the checks S and less than the friction between the top sheet (check S) and the supply roller. As a result, only the topmost of the multiple checks S on the supply roller side is separated and transported, and the other checks S remain in the paper insertion part 11.

In other words, the topmost check S is separated from the other checks S therebelow by balancing these forces.

When the supply roller 20 rotates further, the circular arc part 23 of supply roller 20 pushes against the separation pad 40 with the check S therebetween, and the check S is thus held between the separation pad 40 and circular arc part 23 as shown in FIG. 3.

As a result, only one check S is separated from the stack and advanced from the paper insertion part 11 by the circular arc part 23 of supply roller 20 as it slides over the pad surface 41 and is carried smoothly out from the paper supply device M1 (such as into a downstream paper transportation path) by rotation of circular arc part 23. As described above, the force of separation pad 40 against the circular arc part 23 is set greater than that of pressure member 30 so that the check S is gripped reliably with the circular arc part 23, and the single gripped check S can be reliably conveyed downstream.

When rotation of the circular arc part 23 of supply roller 20 finishes conveying the one check S, the action of pressure member drive cam 26 timed to the trailing end 23B of circular arc part 23 passing a position opposite the pressure member 30 returns the pressure member 30 to the standby position.

Furthermore, substantially simultaneously thereto, the circular arc part 23 pressed to the separation pad 40 rotates passed the separation pad 40, and the separation pad 40 becomes positioned opposite bowed part 24. Interference in the rocking range of the separation pad 40 is therefore eliminated, the cam follower 48 drops into the cutout 27*a* of pad drive cam 27, and restraint of the separation pad 40 is thus released. As a result, the force of torsion spring 43 returns the separation pad 40 to the standby position substantially perpendicular to the paper insertion part 11.

When the single topmost check S on the supply roller side is separated and transported from a stack of multiple checks S, one or more checks S below the surface check also move somewhat toward the separation pad 40 due to friction between the checks S. However, the ends of the checks S that thus move are again realigned with the rest of the stack when the separation pad 40 returns to the standby position. Because the pressure member 30 is displaced to the standby position separated from the supply roller 20 at this time, the checks S move relatively freely, and the ends of the checks S can be easily realigned by the separation pad 40.

Each time the supply roller 20 turns one revolution and the bowed part 24 of the supply roller 20 turns to the pressure member 30, the separation pad 40 rocks between a standby position substantially perpendicular to the paper insertion part 11 and a transportation position touching the ends of the checks S at a specific angle, and the separation pad 40 thus works to align the ends of the checks S.

A paper supply device M1 according to this embodiment of the invention can thus reliably nip and feed even checks S located in the paper insertion part 11 with the leading end of the check S offset to the upstream side in the paper feed direction using only a single supply roller 20. More specifically, this paper supply device M1 can reliably supply forms that are stacked without the ends being neatly aligned.

The paper supply device is therefore simple and small compared with a paper supply device having multiple rollers. Furthermore, because gravity is not used to align the ends of the checks S, this paper supply device can be easily adapted to holding checks S in an upright position with the lengthwise ends oriented horizontally. As a result, this paper supply device can be used in printers, data readers, and other devices with no particular limitation on device orientation.

In a paper supply device M1 according to this first embodiment of the invention, the pressure member control mechanism 37 and pad control mechanism 47 include pressure member drive cam 26 and pad drive cam 27, and cam followers 38, 48 disposed to the pressure member 30 and separation pad 40 so as to slide against the corresponding cam surfaces.

As a result, a simple mechanism can be used to drive the pressure member 30 and separation pad 40 in conjunction with rotation of the supply roller 20.

Figure 7:
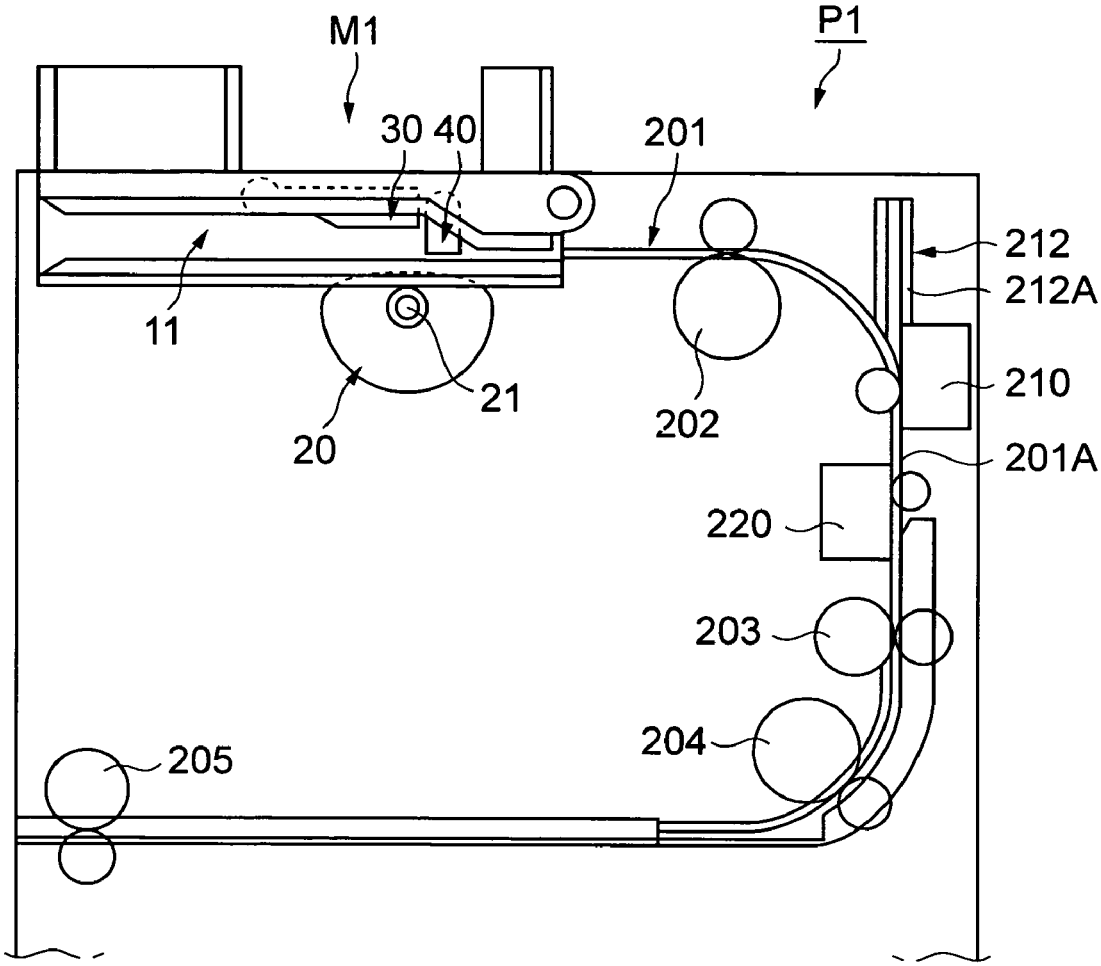
FIG. 7 is a schematic plan view of the layout of a data reader using the paper supply device shown in FIG. 1(*a*)

FIG. 7 is a plan view of a data reader P1 incorporating a paper supply device M1 according to this first embodiment of the invention.

This paper supply device M1 is rendered at the input portion of a U-shaped first transportation path 201 having supply rollers 202, 203, 204 located at appropriate positions along the first transportation path 201, and discharge rollers 205 in the output part. Data readers (scanners) 210, 220 are disposed to the straight middle portion 201A of the U-shaped first transportation path 201. A straight transportation path 212A is rendered in line with the straight middle portion 201A to form a second transportation path 212 by sharing the straight middle portion 201A.

When a check S is supplied from the paper supply device M1 in this data reader P1, the check S moves in an upright posture through the U-shaped first transportation path 201 and data is read from the check S by the data readers (scanners) 210, 220 as the check S travels by. The second transportation path 212 is used to convey driver licenses, ID cards, or other stiff card-like media for reading by the data readers 210, 220.

When a stack of multiple checks S is set standing on edge in the loading section and supplied horizontally in this vertical posture, the leading edges of the checks S are often not precisely aligned with each other. Even when the form edges are thus randomly arranged, a paper supply device M1 according to this second embodiment of the invention can reliably feed the checks S one at a time. Reliable paper supply can therefore be assured using a simple mechanism without being limited to a particular device posture.

Figure 8:
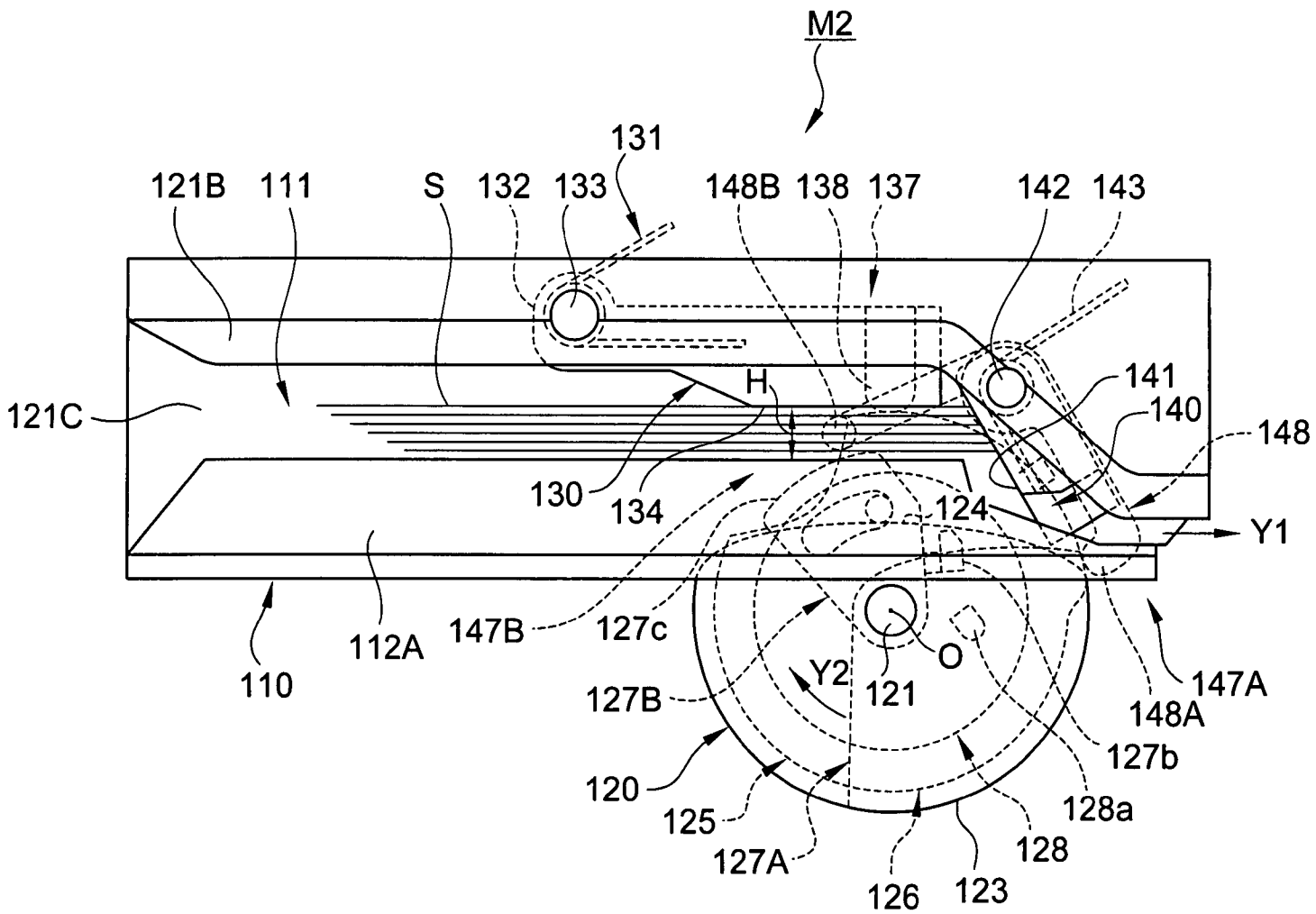
FIG. 8 is a plan view schematically showing the arrangement of a paper supply device according to a second embodiment of the invention.
Figure 9:
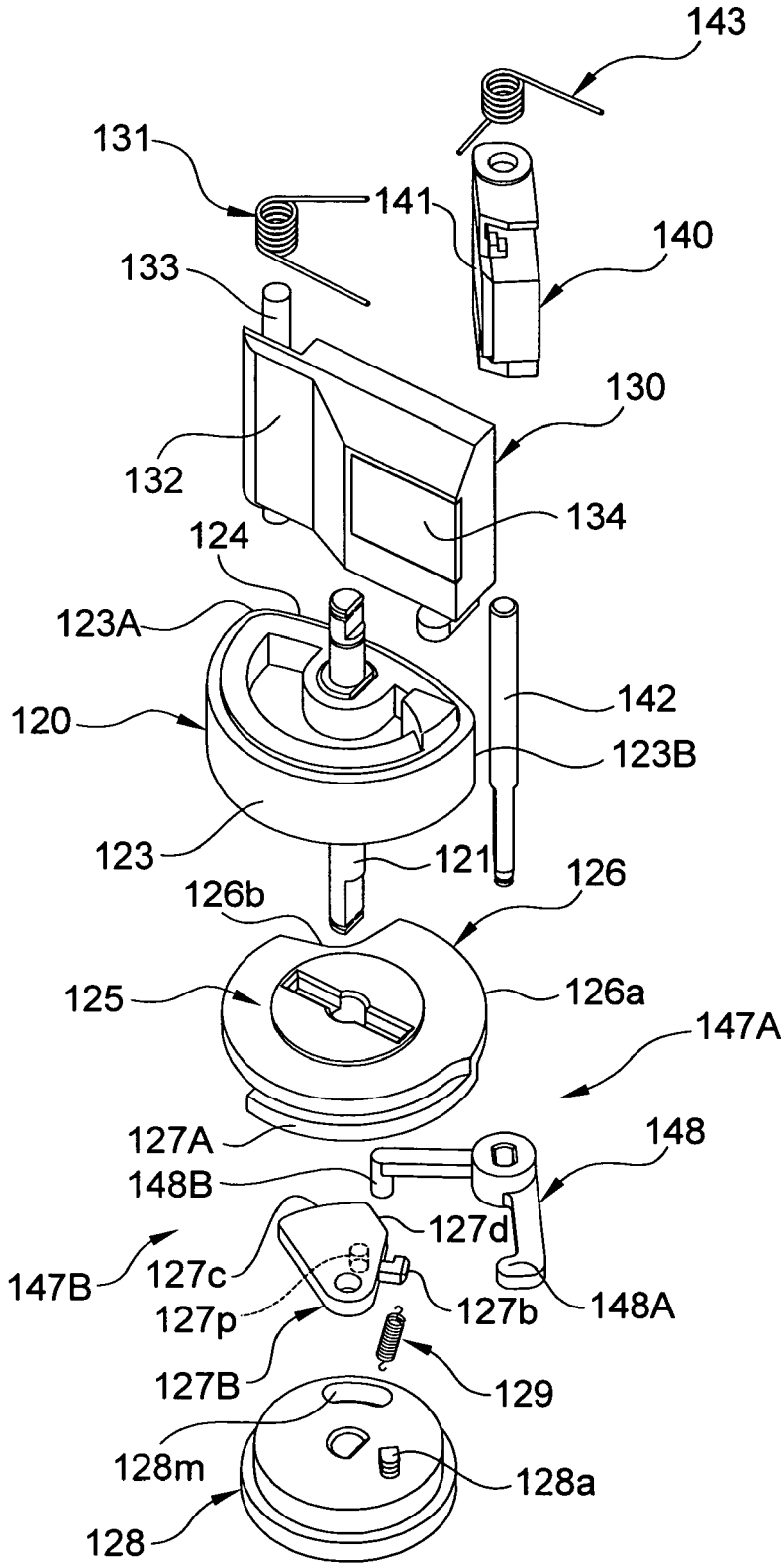
FIG. 9 is an exploded oblique view showing the essential parts of the paper supply device of FIG. 8.
Figure 10:
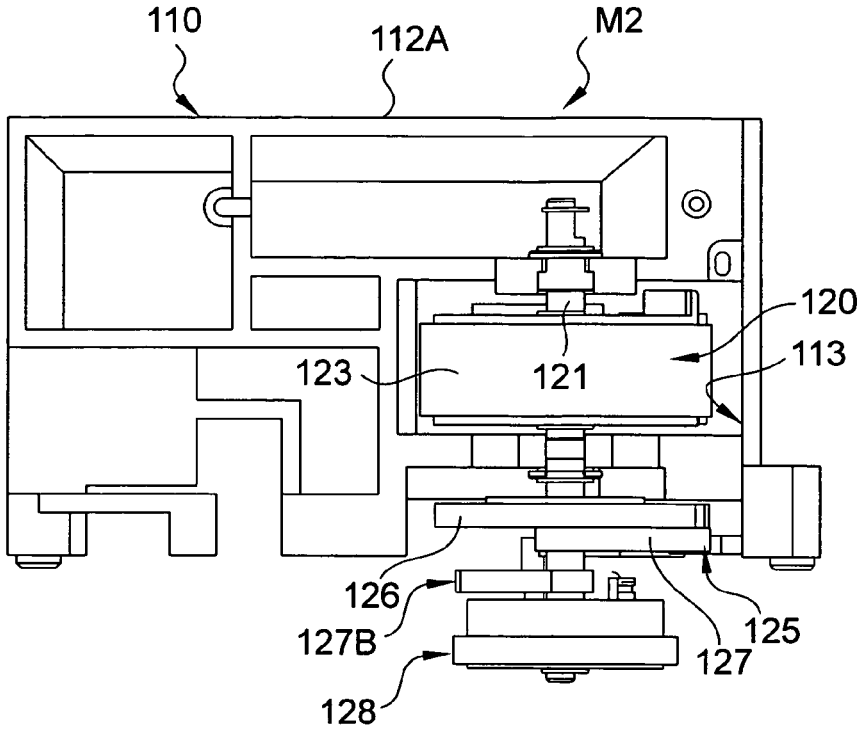
FIG. 10 is a side view showing the overall configuration of the paper supply device shown in FIG. 8.

FIG. 8 is a plan view schematically showing the paper supply device of a second embodiment of the invention, FIG. 9 is an exploded oblique view showing the arrangement of the main parts, FIG. 10 is a side view of the paper supply device shown in FIG. 8, and FIG. 11 to FIG. 15 show the relative positions of the main parts shown in FIG. 8.

With a paper supply device M2 according to this second embodiment of the invention as shown in FIG. 8, checks (paper) S are set standing on edge in paper holder 110 with the lengthwise ends facing the horizontal direction (the right side in the figure), and are conveyed horizontally in this posture in the direction of arrow Y1.

The paper holder 110 is fixed to a frame not shown, and includes a pair of side walls 112A, 112B forming paper insertion part 111 where a batch of multiple checks S can be loaded, and a bottom 112C on which the bottom edges of the checks S rest.

The main components whereby this paper supply device M2 supplies one check S at a time from the stack of checks S in the paper holder 110 include supply roller 120, pressure member 130, and separation pad 140.

The supply roller 120 is disposed on the side of one wall 112A of the paper holder 110, and the pressure member 130 is disposed on the side of the other wall 112B on the opposite side of the paper insertion part 111. The separation pad 140 is located downstream from the pressure member 130 in the check S feed direction (the direction of arrow Y1).

The supply roller 120 is fixed to roller shaft 121 supported freely rotatably on a frame not shown. The supply roller 120 is rotationally driven in the direction of arrow Y2 by a motor (drive means) not shown to supply a check S using the roller surface of the supply roller 120 to the downstream paper transportation path. The roller shaft 121 is rendered perpendicular (vertically in the figures) to the transportation direction in order to turn the supply roller 120 in the transportation direction.

The supply roller 120 is fan-shaped with a circular arc part 123 and a bowed part 124. The circumferential surface of the circular arc part 123 is the surface of an imaginary cylinder concentric to the axis of rotation O of the supply roller 120, and the bowed part 124 is a gradually curved surface pulled to the inside from the surface of the imaginary cylinder.

The surface of this supply roller 120 is lined with rubber or other high friction material. The supply roller 120 is disposed so that as the circular arc part 123 turns, it protrudes into the space inside the paper insertion part 111 through an aperture 113 formed in the one wall 112A of the paper holder 110 as shown in FIG. 10.

The pressure member 130 (also called a hopper) is positioned opposite the surface of the supply roller 120 from the other side of the paper insertion part 111. The pressure member 130 is urged toward the supply roller 120 by torsion spring (first elastic member) 131, and thereby presses the checks S to the surface of the supply roller 120.

The pressure member 130 is disposed substantially parallel to the other wall 112B of the paper holder 110 in an aperture (not shown) formed in that wall 112B. The base portion 132 of the pressure member 130 on the upstream side in the transportation direction is supported by a shaft 133 fixed to the frame, enabling the free end of the pressure member 130 to pivot on the shaft 133. The shaft 133 is parallel to the axis of rotation O of the supply roller 120.

The part of the pressure member 130 that contacts the checks S protrudes to the supply roller 120 side from the rest of the pressure member 130, forming the pressure surface 134 to which a cork sheet or other high friction material is disposed. The top and base portion 132 sides of this pressure surface 134 are sloped so that they do not interfere with dropping checks S into the paper insertion part 111.

The separation pad 140 separates one check S at a time from the multiple checks S stocked in the paper insertion part 111 as a result of the leading end of the check S conveyed between the supply roller 120 and pressure member 130 sliding over the pad surface 141.

This friction separation pad 140 is pivotally supported around support shaft 142 located near the free end of the pressure member 130, and the pivoting free end is resiliently urged in the direction of the trailing end of the check S by a torsion spring 143 (second elastic member).

As shown in FIG. 8, the separation pad 140 is held in the standby position when there is no interference from the circular arc part 123 of the supply roller 120 protruding into the paper insertion part 111. As described and shown in FIG. 1 to FIG. 6, when the separation pad 40 is in the standby position in the first embodiment, the separation pad 40 contacts the ends of the checks S substantially perpendicularly. In this embodiment, however, the separation pad 140 contacts the ends of the checks S at approximately 60 degrees. As further described below, the angle of the separation pad 140 is determined by cam follower 148A contacting the pad drive cam 127A. This angle is also held by cam follower 148B contacting pad lock cam 127B. The ends of checks S loaded into the paper insertion part 11 can thus be positioned.

This paper supply device M2 also has a pressure member control mechanism 137 and pad control mechanism 147A for displacing the pressure member 130 and separation pad 140 according to the rotational position of the supply roller 120, and a pad rotation regulating mechanism 147B for holding the separation pad 140 in the standby position for positioning the ends of the checks S.

The pressure member control mechanism 137 includes the pressure member drive cam (cam surface) 126 of disc cam 125, and a cam follower 138 disposed on the pressure member 130 to slide in contact with the pressure member drive cam 126. The pressure member drive cam 126 is fixed to the roller shaft (rotational axis) 121 of the supply roller 120 and rotates in unison with the supply roller 120.

The pad control mechanism 147A includes the pad drive cam 127A (cam surface) of the disc cam 125, and a cam follower 148A fixed to a member (L-shaped lever 148 described below) of the separation pad 140 to slide against the pad drive cam 127A. The pad drive cam 127A is fixed to the roller shaft 121 of the supply roller 120 and rotates in unison with the supply roller 120.

The pad rotation regulating mechanism 147B includes pad lock cam 127B and cam follower 148B. The pad lock cam 127B is a cam member that is fixed to the roller shaft 121 of the supply roller 120 and normally rotates in unison with the supply roller 120. The cam follower 148B is assembled to a member (L-shaped lever 148) of the separation pad 140 so that it contacts the pad lock cam 127B.

As shown in FIG. 9, this L-shaped lever 148 having cam followers 148A and 148B is press-fit to and pivots in unison with support shaft 142, which is supported on the frame to rotate with the separation pad 140.

As shown in FIG. 9 and FIG. 10, a transfer gear 128 for transferring rotation of a motor not shown to the supply roller 120 and disc cam 125 by way of intervening roller shaft 121 is fixed to the bottom end of the roller shaft 121 of supply roller 120.

The pad lock cam 127B is a basically fan-shaped cam with external first cam surface 127*c* and second cam surface 127*d*, and is assembled to the roller shaft 121 between the transfer gear 128 and disc cam 125 so that it can rotate through a specific angular range.

More specifically, an engaging pin 127*p* protruding from the bottom of the pad lock cam 127B is insertion fit to a curved channel 128*m* of a specific length formed in the top of the transfer gear 128 so that the pad lock cam 127B can rotate only within a specific angular range around the roller shaft 121 relative to the transfer gear 128.

A tension spring 129 is hooked on catch 127*b* of pad lock cam 127B and catch 128*a* of transfer gear 128. This tension spring 129 resiliently urges the pad lock cam 127B in the direction of arrow Y2 relative to the transfer gear 128, and the engaging pin 127*p* normally contacts the front end of the curved channel 128*m* in the direction of rotation.

The disc cam 125 thus has a pressure member drive cam 126 followed by the cam follower 138 of pressure member 130, and a pad drive cam 127A followed by cam follower 148A of the L-shaped lever 148. The disc cam 125 is fixed to the roller shaft 121, and the pressure member 130 and separation pad 140 are thus driven in conjunction with rotation of the supply roller 120.

Figure 11:
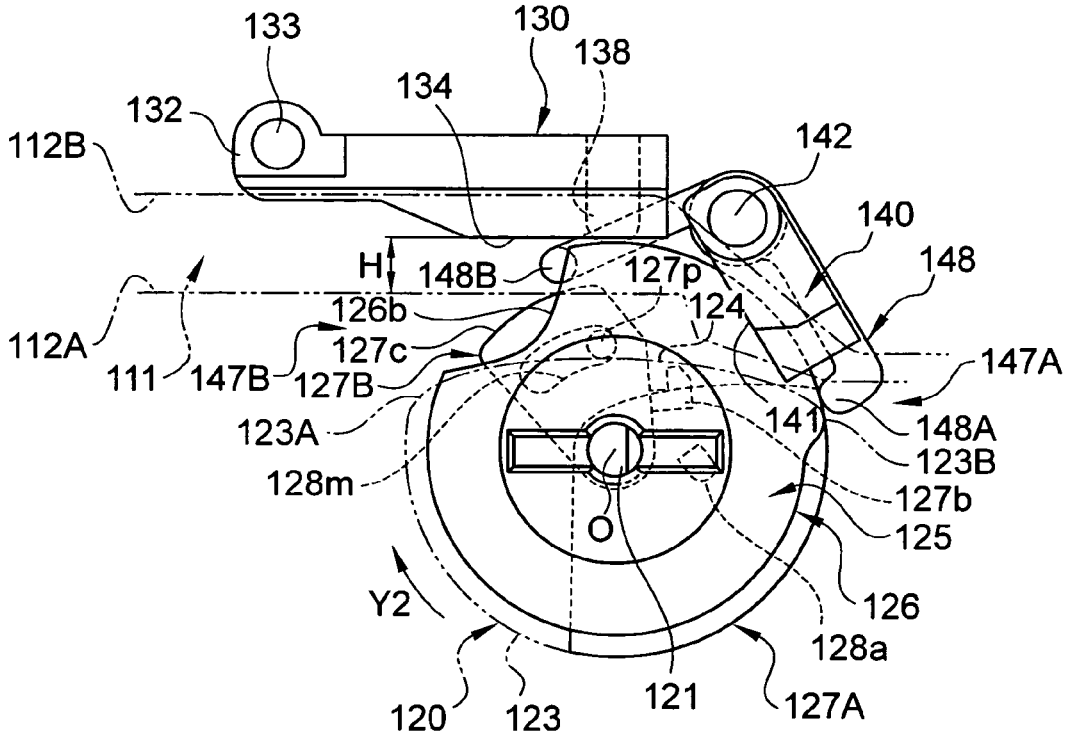
FIG. 11 describes the relative positions of essential parts shown in FIG. 8.
Figure 12:
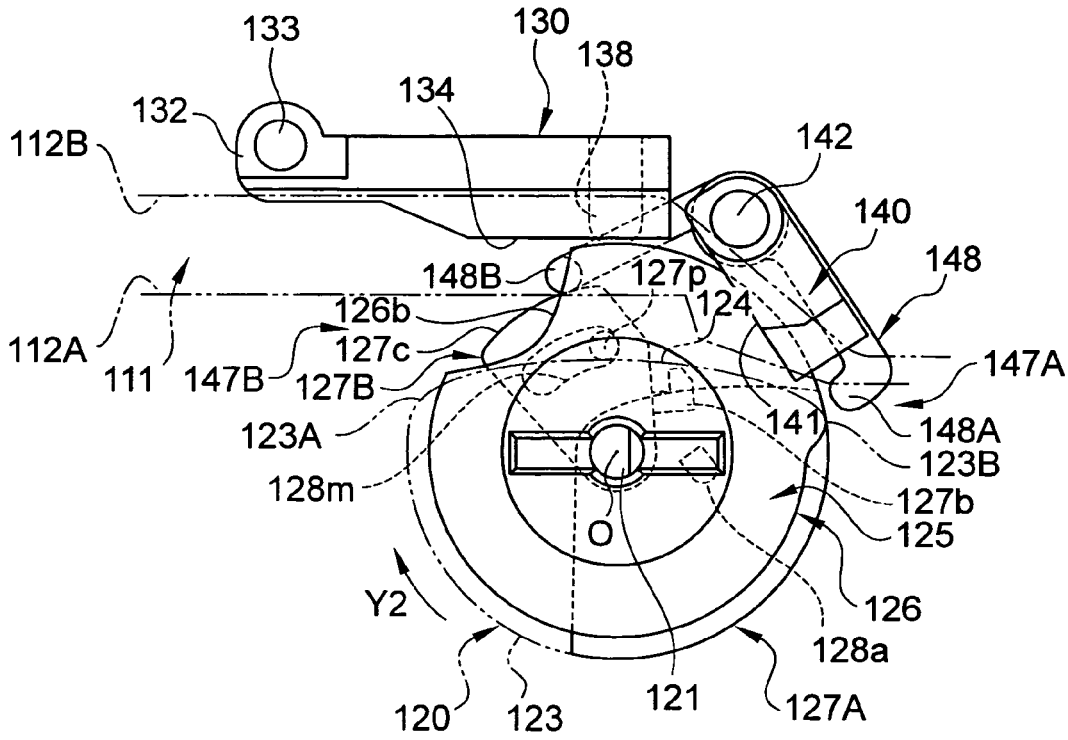
FIG. 12 describes the action of the major parts shown in FIG. 11.

The cam profile of the pressure member drive cam 126 of the pressure member control mechanism 137 regulates the position of the pressure member 130 to the supply roller 120 in resistance to the force of the torsion spring 131 so that the pressure member 130 is displaced to a position separated from the supply roller 120 (the standby position) when the bowed part 124 of the supply roller 120 is in the standby position substantially parallel to the pressure member 130 on the opposite side of the paper insertion part 111 as shown in FIGS. 8, 11, and 12.

Figure 13:
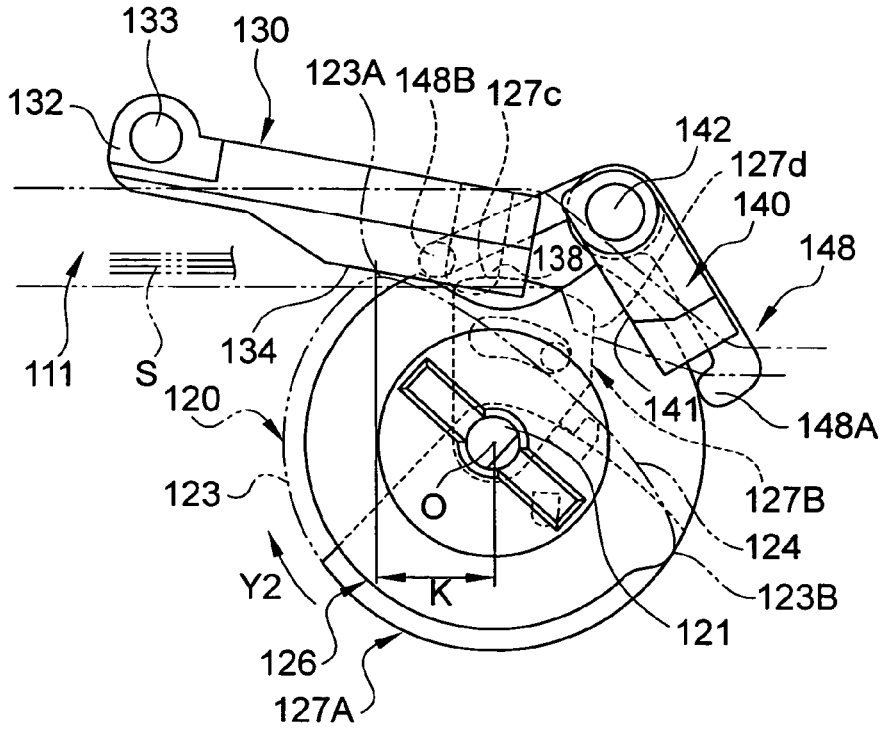
FIG. 13 describes the next stage in the operation of the major parts shown in FIG. 11.

As shown in FIG. 13, when the leading edge 123A of the circular arc part 123 of supply roller 120 (that is, the part where the surface of the supply roller 120 changes from the bowed part 124 to the circular arc part 123) starts to approach the pressure member 130 and while the circular arc part 123 is opposite the pressure member 130, the pressure member 130 is released from the constraint holding the pressure member 130 in the standby position. As a result, the pressure member 130 is displaced to the position (pressure position) where the force of torsion spring 131 urges the pressure member 130 toward the circular arc part 123 of supply roller 120.

As shown in FIG. 11 and FIG. 12, the cam profile of the pad lock cam 127B of the pad rotation regulating mechanism 147B is configured so that when the bowed part 124 of the supply roller 120 is in the standby position substantially parallel to the pressure member 130 with the paper insertion part 111 therebetween, the first cam surface 127*c* contacts the cam follower 148B and the separation pad 140 is thus locked and prevented from turning. As a result, when the pressure member 130 is in the standby position, the separation pad 140 will not move even if it is pushed by the ends of checks S loaded to the paper insertion part 111. The checks S are thus prevented from being inserted to a point downstream from the separation pad 140.

Figure 14:
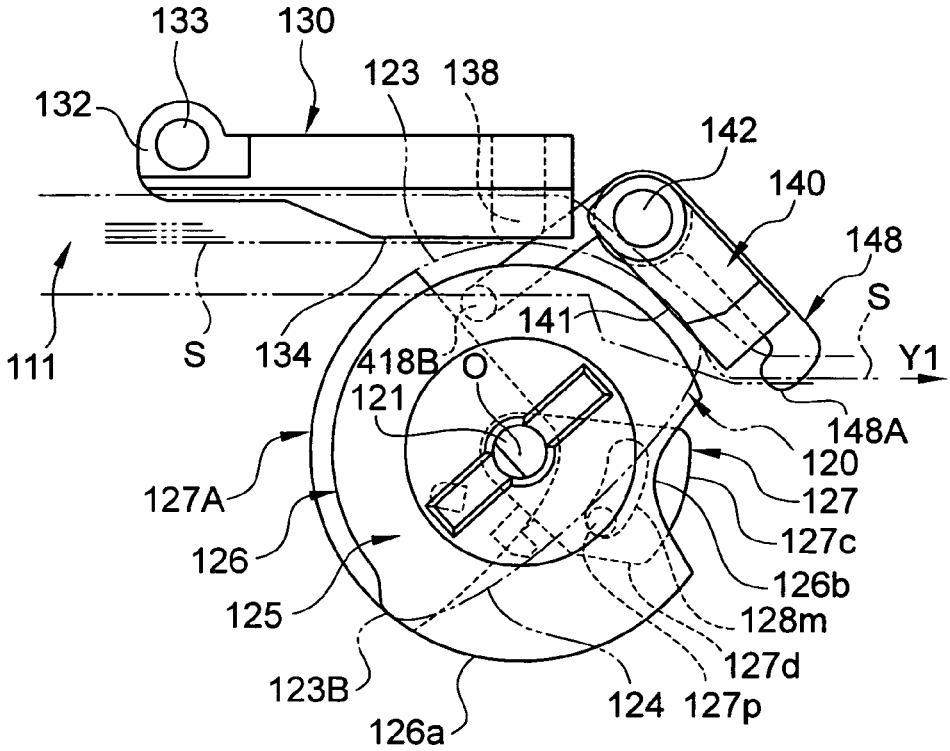
FIG. 14 describes the next stage in the operation of the major parts shown in FIG. 13.

The cam profile of the pad lock cam 127B of the pad rotation regulating mechanism 147B is further configured so that the separation pad 140 is thus unlocked (released) as a result of the cam follower 148B separating from the first cam surface 127*c* from when the leading edge 123A of the circular arc part 123 of the supply roller 120 begins to contact the pressure member 130 and while it contacts the checks S as shown in FIG. 13. As shown in FIG. 14, when the released separation pad 140 is urged to the circular arc part 123 of the supply roller 120 by the force of torsion spring 143, the ends of the checks S contact the separation pad 140 at an approximately 45 degree angle.

Figure 15:
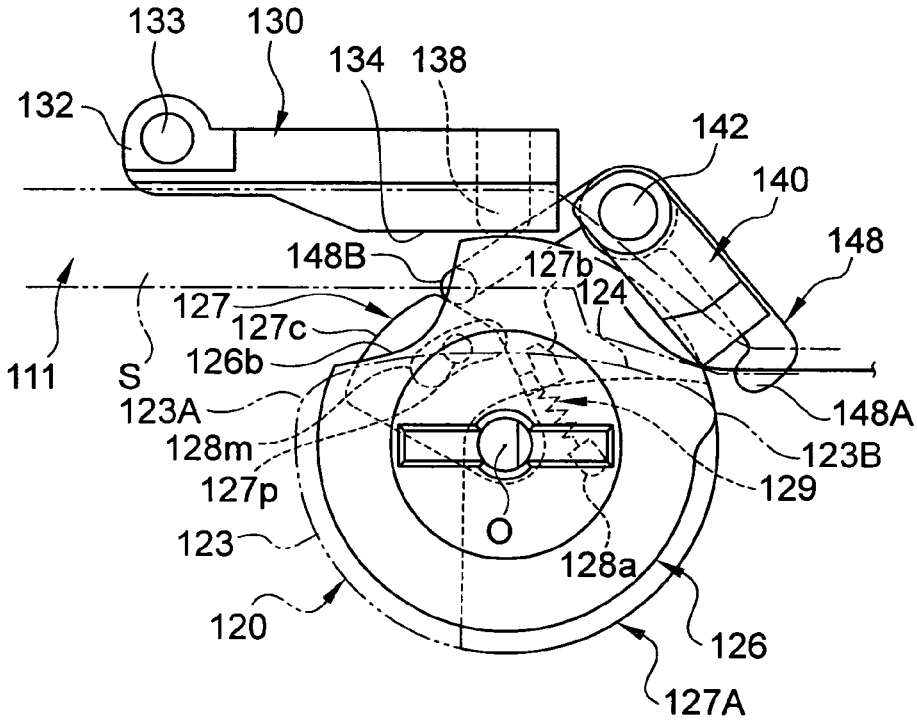
FIG. 15 describes the action in the next stage of the operation of the major parts shown in FIG. 14.

As shown in FIG. 15, the cam profile of the pad lock cam 127B of the pad rotation regulating mechanism 147B is configured so that the second cam surface 127*d* contacts cam follower 148B while the pivoting free end of the separation pad 140 is in contact with the checks S being supplied. As a result, while delaying rotation of the pad lock cam 127B, which is rendered so that rotation thereof can be delayed a known distance, in the rotary drive direction of the supply roller 120, the separation pad 140 is prevented from rotating to the posture where it can position the ends of the checks S.

Operation of a paper supply device M2 according to this second embodiment of the invention is described next.

When checks S are supplied from a stack of multiple checks S by a paper supply device M2 according to this embodiment of the invention, the stack of checks S is set in the paper holder 110 standing on edge with the ends of the checks S in the horizontal direction (the leading edge to the right as seen in the figures) as shown in FIG. 8 and FIG. 11.

The greatest-radius cam portion 126*a* of the pressure member drive cam 126 contacts cam follower 138 of pressure member 130 at this time, and the pressure member 130 is thus held at the standby position separated from the supply roller 120 in resistance to the force of torsion spring 131. Furthermore, because the bowed part 124 of supply roller 120 is positioned substantially parallel to the pressure member 130, the paper insertion part 111 is open to the widest effective width H, and multiple checks S can be easily inserted.

The separation pad 140 is also held in a position (blocking the paper path downstream of the paper insertion part 111: the standby position) substantially perpendicular to the paper insertion part 111 where the separation pad 140 can position the ends of the checks S as a result of cam follower 148A following the pad drive cam 127A.

The separation pad 140 can thus align the ends of the checks S when checks S are loaded to the paper insertion part 111 when the bowed part 124 of the supply roller 120 is in the standby position opposite the pressure member 130. That is, checks S loaded into the paper insertion part 111 are prevented from unintentionally entering the downstream paper transportation path, and feeding two or more sheets together at the same time is prevented.

If the position of the separation pad 140 is regulated only by the force of torsion spring 143 and the separation pad 140 is pushed with much force by the ends of the checks S, the torsion spring 143 can be easily overpowered and the separation pad 140 forced to turn in the same direction as the end of the checks are advancing (the "leading end direction" below, which is counterclockwise as seen in the figures).

As a result, the ends of the checks S may not be appropriately positioned and aligned. This problem is prevented in a paper supply device M2 according to this embodiment of the invention by providing the pad rotation regulating mechanism 147B. As described above, the pad rotation regulating mechanism 147B locks the separation pad 140 in the posture where it can position the ends of the checks S and restricts rotary displacement of the separation pad 140 in the leading end direction. As a result, the ends of the checks S can be reliably aligned.

More specifically, as shown in FIG. 12, when the bowed part 124 of the supply roller 120 is in the standby position substantially parallel to the pressure member 130 with the paper insertion part 111 therebetween, the first cam surface 127*c* of the pad lock cam 127B of the pad rotation regulating mechanism 147B rests in contact with the cam follower 148B.

As a result, even if the separation pad 140 is pushed by checks S so as to pivot in the leading end direction, further pivoting of the separation pad 140 is prevented because cam follower 148B is touching first cam surface 127*c* of pad lock cam 127B.

Setting the checks S to a position too far into the paper supply device can thus be reliably prevented by thus restricting rotation of the separation pad 140 in the leading end direction.

When rotation of the motor not shown is then transferred to the supply roller 120 by way of intervening transfer gear 128, supply roller 120 turns in the direction of arrow Y2, and the leading edge 123A of the circular arc part 123 of the supply roller 120 gradually approaches the pressure member 130 side as shown in FIG. 13.

When the cam follower 138 of pressure member 130 then drops into the cutout 126*b* of the pressure member drive cam 126, the pressure member 130 is released from the standby position, and thus pushes the checks S to the surface of the supply roller 120.

Because the supply roller 120 is now positioned with the leading edge 123A of the circular arc part 123 juxtaposed to the pressure member 130 on the upstream side of the supply roller 120 axis of rotation O in the paper feed direction (that is, the left side in FIG. 13), the checks S first touch the leading edge 123A of the circular arc part 123 of supply roller 120 at a position on the upstream side of the axis of rotation O in the feed direction. This position is distance K on the upstream side from the axis of rotation O of the supply roller 120. This distance K is approximately ½ the radius of supply roller 120. Therefore, even if the leading edge of the checks S is distance K upstream from the axis of rotation O, the circular arc part 123 of supply roller 120 can reliably nip the leading end of the check S.

When supply roller 120 rotates further from this position, rotation of the circular arc part 123 pushes the pressure member 130 back toward the standby position, and the topmost check S is conveyed off the stack in the feed direction (in the direction of arrow Y1) between the surface of circular arc part 123 and the pressure member 130 as shown in FIG. 14.

Because the pressure member 130 is urged to the circular arc part 123 of supply roller 120 by the torsion spring 131 at this time, the friction created between the circular arc part 123 of supply roller 120 and the one check S on the surface of the stack of checks S between the pressure member 130 and said circular arc part 123 (i.e., the check S on the feed roller side) works to convey only the top check S. Friction also occurs between the other sheets held therebetween, and the friction between each of the sheets works to convey all of the checks S to the separation pad 140.

As shown in FIG. 13, by this time the cam follower 148B has already separated from the first cam surface 127*c* of pad lock cam 127B in the pad rotation regulating mechanism 147B. The separation pad 140 is thus released, and the only part constraining the movement of the separation pad 140 at this time is the force of torsion spring 143 urging cam follower 148A to the pad drive cam 127A.

The ends of checks S contact the separation pad 140 at a specific angle (approximately 60 degrees in this embodiment), but because the separation pad 140 is urged to the paper insertion part 111 side by the force of torsion spring 143, a force working to prevent checks S from being conveyed is produced between the separation pad 140 and checks S. The force of torsion spring 131 and torsion spring 143, and the angle at which the ends of checks S meet the separation pad, are set so that the force inhibiting transportation of the checks S is greater than the friction between the individual checks S and less than the friction between the topmost check and the supply roller. As a result, only the single topmost check of the multiple checks S, that is, the check S on the supply roller side, is separated from the stack and conveyed, and the other checks S remain in the paper insertion part. The single topmost check S can thus be separated from the other checks S therebelow by balancing these forces.

When the supply roller 120 rotates further, the circular arc part 123 of supply roller 120 pushes against the separation pad 140 with the check S therebetween, and the check S is thus held between the separation pad 140 and circular arc part 123 as shown in FIG. 14. The separation pad 140 at this time is pushed by the circular arc part 123 of the supply roller 120 and rotates against the force of the torsion spring 143, and the end of the check S contacts the separation pad 140 at an approximately 45 degree angle.

As a result, only one check S advanced from the paper insertion part 111 by the circular arc part 123 of supply roller 120 is separated from the stack as it slides over the pad surface 141 and is carried smoothly out from the paper supply device M2 (such as into a downstream paper transportation path) by rotation of circular arc part 123. As described above, the force of separation pad 140 against the circular arc part 123 is set greater than that of pressure member 130 so that the check S is gripped reliably with the circular arc part 123, and the single gripped check S can be reliably conveyed downstream.

The pressure member 130 is returned to the standby position by the action of pressure member drive cam 126 timed to the trailing end 123B of circular arc part 123 rotating passed a position opposite the pressure member 130 late in the conveyance of one check S by rotation of the circular arc part 123 of supply roller 120.

When the circular arc part 123 opposite the separation pad 140 then rotates passed the separation pad 140 and the separation pad 140 becomes positioned opposite the bowed part 124, the separation pad 140 is rotated toward the trailing end of the paper (the "trailing end direction" below, that is, clockwise as seen the figures) by the force of torsion spring 143 because there are no longer any obstacles in the range through which the separation pad 140 pivots. The cam follower 148A therefore contacts the pad drive cam 127A, and the separation pad 140 returns to the standby position.

When the single topmost check S on the supply roller side is separated and transported from a stack of multiple checks S, one or more checks S below the surface check also move somewhat toward the separation pad 140 due to friction between the checks S, but the checks S that have thus moved are also pushed back by the separation pad 140 so that the ends thereof are again aligned with each other. Because the pressure member 130 is displaced to the standby position at this time, the checks S move relatively freely, and the ends of the checks S can be easily realigned by the separation pad 140.

The separation pad 140 thus works to align the ends of the checks S each time the supply roller 120 turns one revolution and the bowed part 124 of the supply roller 120 again faces the pressure member 130.

As shown in FIG. 15, however, the trailing end of the check S is in contact with the separation pad 140 even after the circular arc part 123 of the supply roller 120 has passed. That is, the pivoting free end of the separation pad 140 is in contact with the check S being conveyed, and the separation pad 140, which is prevented from pivoting, cannot move to the standby position shown in FIG. 11.

The cam follower 148B then contacts the second cam surface 127*d* of pad lock cam 127B, which rotates in the direction of arrow Y2 with the transfer gear 128. Thus, because the pad lock cam 127B is rendered so that rotation is delayed a specific distance in the rotary drive direction of the supply roller 120, the pad lock cam 127B pushing the second cam surface 127*d* against the cam follower 148B produces a delay in rotation in resistance to the force of tension spring 129.

At this point the separation pad 140 is not pivoted to the position where it can align the ends of the checks S, and the cam follower 148B is not in contact with the first cam surface 127*c* of the pad lock cam 127B. As a result, the separation pad 140 is not restricted from pivoting in the leading end direction.

Once the trailing end of the check S completely passes the separation pad 140, there is nothing obstructing the separation pad 140 from pivoting, and the force of the torsion spring 143 causes the separation pad 140 to pivot in the trailing end direction. The cam follower 148B therefore separates from the second cam surface 127*d*, and the force of the tension spring 129 causes the pad lock cam 127B to return to the initial position with the engaging pin 127*p* touching the front end of the curved channel 128*m* in the direction of rotation.

If the trailing end of the check S has already passed the separation pad 140 when the pad lock cam 127B contacts the cam follower 148B, the separation pad 140 can pivot freely toward the trailing end of the stack. The cam follower 148B can thus move to the position enabling contact with the first cam surface 127*c* without contacting the second cam surface 127*d*.

When the rotating free end of the separation pad 140 is in contact with the check S being supplied, the paper supply device M2 according to this second embodiment of the invention prevents the separation pad 140 from applying unnecessary force to the check S, and a paper supply operation that is stable to the end can be achieved.

A paper supply device M2 according to this second embodiment of the invention can thus reliably nip and feed even checks S located in the paper insertion part 111 with the leading end of the check S on the upstream side in the paper feed direction using only a single supply roller 120. More specifically, this paper supply device M2 can reliably supply forms that are stacked without the ends being neatly aligned.

The paper supply device is therefore simple and small compared with a paper supply device having multiple rollers. Furthermore, because gravity is not used to align the ends of the checks S, this paper supply device can be easily adapted to holding checks S in an upright position with the lengthwise ends oriented horizontally. As a result, this paper supply device can be used in printers, data readers, and other devices with no particular limitation on device orientation.

Figure 16:
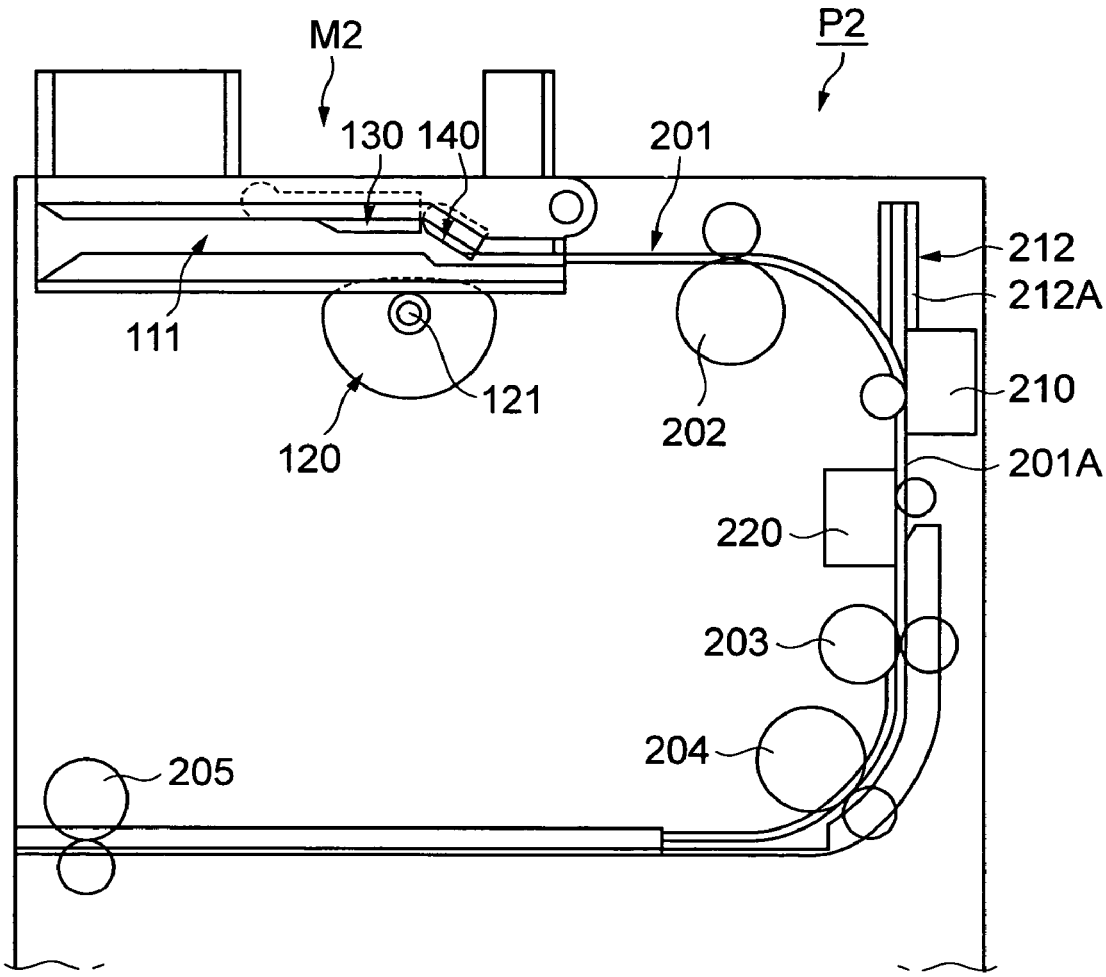
FIG. 16 is a schematic plan view of the layout of a data reader using the paper supply device shown in FIG. 8.

FIG. 16 is a plan view of a data reader P2 incorporating a paper supply device M2 according to this second embodiment of the invention.

This paper supply device M2 is rendered at the input portion of a U-shaped first transportation path 201 having supply rollers 202, 203, 204 located at appropriate positions along the first transportation path 201, and discharge rollers 205 in the output part. Data readers (scanners) 210, 220 are disposed to the straight middle portion 201A of the U-shaped first transportation path 201. A straight transportation path 212A is rendered in line with the straight middle portion 201A to form a second transportation path 212 by sharing the straight middle portion 201A.

When a check S is supplied from the paper supply device M2 in this data reader P2, the check S moves in an upright posture through the U-shaped first transportation path 201 and data is read from the check S by the data readers (scanners) 210, 220 as the check S travels by. The second transportation path 212 is used to convey driver licenses, ID cards, or other stiff card-like media for reading by the data readers 210, 220.

When a stack of multiple checks S is set standing on edge in the loading section and supplied horizontally in this vertical posture, the leading edges of the checks S are often not precisely aligned with each other. Even when the form edges are thus randomly arranged, a paper supply device M2 according to this second embodiment of the invention can reliably feed the checks S one at a time. Reliable paper supply can therefore be assured using a simple mechanism without being limited to a particular device posture.

It will be obvious to one with ordinary skill in the related art that the arrangement of the paper insertion part, supply roller, pressure member, pressure member control mechanism, separation pad, pad rotation regulating mechanism, pad control mechanism, and disc cam in the paper supply device described above according to the present invention shall not be so limited, and can be varied in many ways without departing from the scope of the accompanying claims.

For example, the pressure member 30 (130) in the above embodiments is arranged so that the free end thereof can pivot on a shaft 33 (133) parallel to the axis of rotation O of the supply roller 20 (120), but could be arranged so that the pressure surface advances and retracts parallel to the axis of rotation O of the supply roller 20 (120).

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A paper supply device for feeding sheets of paper along a paper feed direction comprising:

a paper insertion part for holding a plurality of said sheets of paper with each sheet of paper having opposite ends and a leading edge directed inwardly toward the paper insertion part;

a supply roller that is rotationally driven having a fan-shaped profile including a circular arc part and a bowed part;

a pressure member disposed opposite the supply roller for urging the leading edge of each individual sheet of paper in the paper insertion part toward the supply roller in accordance with a given rotational position of the supply roller;

a first elastic member connected to the pressure member to cause the pressure member to apply force of a first magnitude against the circular arc part of the supply roller;

a separation pad disposed to the paper insertion part downstream from the pressure member in the paper feed direction and being responsive to a displacement of the pressure member for changing the angle of contact of the supply roller with the leading edge of each sheet of paper so as to separate one sheet from a plurality of sheets;

a second elastic member connected to the separation pad to cause the separation pad to apply force of a second magnitude against the circular arc part of the supply roller and wherein the magnitude of force applied by the second elastic member for urging the separation pad to the circular arc part of the supply roller is greater than the magnitude of force applied by the first elastic member for urging the pressure member to the circular arc part of the supply roller.

2. A paper supply device for feeding sheets of paper along a paper feed direction comprising:

a paper insertion part for holding a plurality of said sheets of paper with each sheet of paper having opposite ends and a leading edge directed inwardly toward the paper insertion part;

a supply roller that is rotationally driven having a fan-shaped profile including a circular arc part and a bowed part;

a pressure member in engagement in a first position against the supply roller with the paper insertion part disposed therebetween for urging the leading edge of each individual sheet of paper in the paper insertion part toward the supply roller in accordance with a given rotational position of the supply roller;

a pressure member control mechanism for displacing the pressure member from the first position to another position separated from the supply roller when the bowed part of the supply roller is rotated into a position opposite the pressure member with the paper insertion part therebetween;

a separation pad disposed to the paper insertion part downstream from the pressure member in said paper feed direction, with said separation pad being displaceable into a stand-by position for inhibiting the sheets of paper from being fed past the paper insertion part when there is no interference from said circular arc part of the supply roller protruding into the paper insertion part and being displaceable into an inclined angle position relative to the stand-by position in response to the displacement of said pressure member for changing the angle of contact of the supply roller with the leading edge of each sheet of paper so as to separate one sheet of paper from said plurality of sheets; and a pad control mechanism interconnected to the supply roller so as to rotate in unison therewith and which engages the separation pad for displacing said separation pad into said stand-by position to cause alignment of the ends of the sheets of paper when the supply roller is in the rotated position with the bowed part of the supply roller disposed opposite the pressure member and the paper insertion part therebetween.

3. A paper supply device as described in claim 2, wherein the separation pad is pivotally supported adjacent the pressure member and has a pivoting free end which is urged in the direction opposite the paper feed direction for contacting the sheets of paper in the paper insertion part at an inclined angle.

4. A paper supply device as described in claim 3, further comprising a pad rotation regulating mechanism for locking the separation pad when positioning the ends of the sheets of paper.

5. A paper supply device as described in claim 4, wherein the pad rotation regulating mechanism prevents the separation pad from pivoting when the pivoting free end of the separation pad is in contact with a sheet being conveyed.

6. A paper supply device as described in claim 4, wherein the pad rotation regulating mechanism includes a cam member having a cam surface which rotates in unison with the supply roller, and a cam follower disposed to the separation pad so as to contact the cam surface.

7. A paper supply device as described in claim 6, wherein the cam surface includes:

a first cam surface that contacts the cam follower and locks the separation pad in the posture for positioning the paper ends when the bowed part of the supply roller is opposite the pressure member with the paper insertion part therebetween; and a second cam surface that contacts the cam follower when the pivoting-free end of the separation pad is contacting the sheet being conveyed, and thereby prevents the separation pad from pivoting into the standby position where it can position the paper while producing a rotational delay in the cam member rendered so that rotation can be delayed a specific amount in the rotational drive direction of the supply roller.

8. A paper supply device as described in claim 2, wherein said pad control mechanism engages the separation pad for applying a force thereto which urges the separation pad against the supply roller with a magnitude which is greater than the magnitude of force applied by the pressure member against the supply roller when the circular arc part of the supply roller is opposite the pressure member.

9. A paper supply device as described in claim 2, wherein the pressure member control mechanism and pad control mechanism each comprise a disc cam having two cam surfaces and cam followers disposed to the pressure member and separation pad for sliding against the cam surfaces thereby rotating each disc cam in unison with the supply roller.

* * * * *